US011835899B2

(12) United States Patent
Kanno

(10) Patent No.: US 11,835,899 B2
(45) Date of Patent: Dec. 5, 2023

(54) IMAGE FORMING APPARATUS WITH SETTING FEED INTERVAL BETWEEN RECORDING MATERIALS BASED ON RECEIVED IMAGE SIGNAL

(71) Applicant: CANON KABUSHIKI KAISHA, Tokyo (JP)

(72) Inventor: Naoki Kanno, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/884,653

(22) Filed: Aug. 10, 2022

(65) Prior Publication Data

US 2023/0072975 A1 Mar. 9, 2023

(30) Foreign Application Priority Data

Sep. 3, 2021 (JP) ..... 2021-144068

(51) Int. Cl.
*G03G 15/00* (2006.01)

(52) U.S. Cl.
CPC ..... *G03G 15/50* (2013.01)

(58) Field of Classification Search
CPC ..... G03G 15/50; G03G 15/6564; G03G 15/6558; G03G 15/6561; G03G 2215/00556; G03G 2215/00599
See application file for complete search history.

(56) References Cited

U.S. PATENT DOCUMENTS 7,957,687 B2 6/2011 Ito
9,195,196 B2 11/2015 Kanno et al.
9,454,120 B2 9/2016 Kanno et al.
9,676,575 B2 6/2017 Sakai et al.
10,120,319 B2 11/2018 Kanno
10,401,777 B2 9/2019 Kanno
2007/0286656 A1 12/2007 Ito
2012/0147395 A1* 6/2012 Uchida ..... G03G 15/6561 358/1.9
2015/0220042 A1 8/2015 Kanno
2016/0370748 A1* 12/2016 Tani ..... G03G 15/6564
2017/0219983 A1 8/2017 Kanno

FOREIGN PATENT DOCUMENTS

JP 2008-013369 A 1/2008
JP 2015-143158 A 8/2015
JP 2015-143795 A 8/2015
JP 2016-090954 A 5/2016

* cited by examiner

*Primary Examiner* — Sandra Brase
(74) *Attorney, Agent, or Firm* — Venable LLP

(57) ABSTRACT

An image forming apparatus includes a stacker, a feeding roller, an image forming unit, a detector detecting a recording material, and a controller controlling a feed interval between recording materials continuously fed by the feeding roller. The controller sets the feed interval between a first recording material precedently fed and a second recording material subsequent to the first recording material to a first feed interval based on an image signal. In a case that the detector does not detect a trailing end of the first recording material with respect to a feeding direction after detecting the first recording material until a predetermined time elapses, the controller sets the feed interval to a second feed interval longer than the first interval and determines a timing of image forming on the second recording material by the image forming unit based on the second feed interval.

6 Claims, 13 Drawing Sheets

IMAGE FORMING APPARATUS WITH SETTING FEED INTERVAL BETWEEN RECORDING MATERIALS BASED ON RECEIVED IMAGE SIGNAL

FIELD OF THE INVENTION AND RELATED ART

The present invention relates to an image forming apparatus that uses an electrophotographic process or the like.

Conventional electrophotographic image forming apparatuses are known to include an intermediate transfer member. When such an image forming apparatus performs continuous printing operations, it generally calculates the image forming interval for image formation and the feed interval for feeding paper based on the paper size specified by an external device such as a host computer. The image forming apparatus is controlled so that the timing of image forming and timing of feeding are always at a consistent timing, thereby reducing the possibility of jams and other feed malfunctions and ensuring that the printing operation is carried out correctly. In addition, such image forming apparatuses often have a multipurpose tray (hereinafter referred to as MP tray) as a feeding portion so that users can easily use any size of paper.

In an image forming apparatus with an intermediate transfer belt, the distance from the image forming start position on the photosensitive drum to a secondary transfer portion is generally longer than the distance from a feeding portion where the paper is stacked to a secondary transfer portion where the image is transferred onto the paper. Therefore, image formation is often started prior to the feeding operation in which paper is fed from a feeding portion. However, when image formation is started, it is not known what size of paper (length of paper in the feeding direction) is placed on the feeding portion. Therefore, an image forming interval is set based on the paper size specified by an external device such as a host computer (hereinafter referred to as "specified size"). However, if the size of the paper stacked in the MP tray (hereinafter referred to as "stacked size") is larger than the specified size, the mismatch between the specified size and the stacked size may cause inconsistencies in the timing of image forming and feeding operations, which may result in jams or other feed malfunctions. The term "timing inconsistency" here refers to a control timing discrepancy that occurs when image formation is based on the "specified size" and feeding control is based on the "placed size."

For example, the image forming apparatus proposed in Japanese Laid-Open Patent Application No. 2015-143795 performs the following control. That is, when the stacked size is unknown, image forming control and feeding control are performed based on the maximum size of paper that can be stacked on the feeding portion. The size of the stacked paper is measured by a feed sensor, and when the paper size is determined, the image forming control and feed control are changed to match the size of the stacked paper. This allows printing operations to be performed without causing feeding malfunctions and with minimal loss of productivity.

In the image forming apparatus described above, when printing irregular size paper, the size of the paper is measured during paper feeding by a feed sensor located upstream of the feeding path in the vicinity of the secondary transfer portion.

Therefore, in the printing control in an image forming apparatus, when paper exceeding the maximum size is used or when paper of different sizes is stacked on the same feeding portion and fed, there is a risk of jams and other feeding malfunctions.

SUMMARY OF THE INVENTION

The purpose of the present invention is to suppress the occurrence of feeding malfunctions due to paper size inconsistency.

According to an aspect of the present invention, there is provided an image forming apparatus comprising: a stacking unit on which a plurality of recording materials are stackable; a feeding roller configured to feed the recording material stacked on the stacking unit; an image forming unit configured to form an image on the recording material fed by the feeding roller; a detecting unit configured to detect the recording material fed by the feeding roller toward the image forming unit; and a controlling unit configured to control the image forming unit and the feeding roller, the controlling unit controlling a feed interval between the recording materials continuously fed by the feeding roller, wherein the controlling unit sets the feed interval between a first recording material precedently fed and a second recording material subsequent to the first recording material to a first feed interval based on an image signal which is received, and wherein, in a case that the detecting unit does not detect a trailing end of the first recording material with respect to a feeding direction after detecting the first recording material until a predetermined time elapses, the controlling unit sets the feed interval to a second feed interval longer than the first interval and determines a timing of image forming on the second recording material by the image forming unit based on the second feed interval.

Further features of the present invention will become apparent from the following description of exemplary embodiments with reference to the attached drawings.

DESCRIPTION OF THE EMBODIMENTS

The following is a detailed explanation of the embodiments of the present invention with reference to the drawings.

Embodiment 1

[Configuration of the Image Forming Apparatus]

Figure 1:
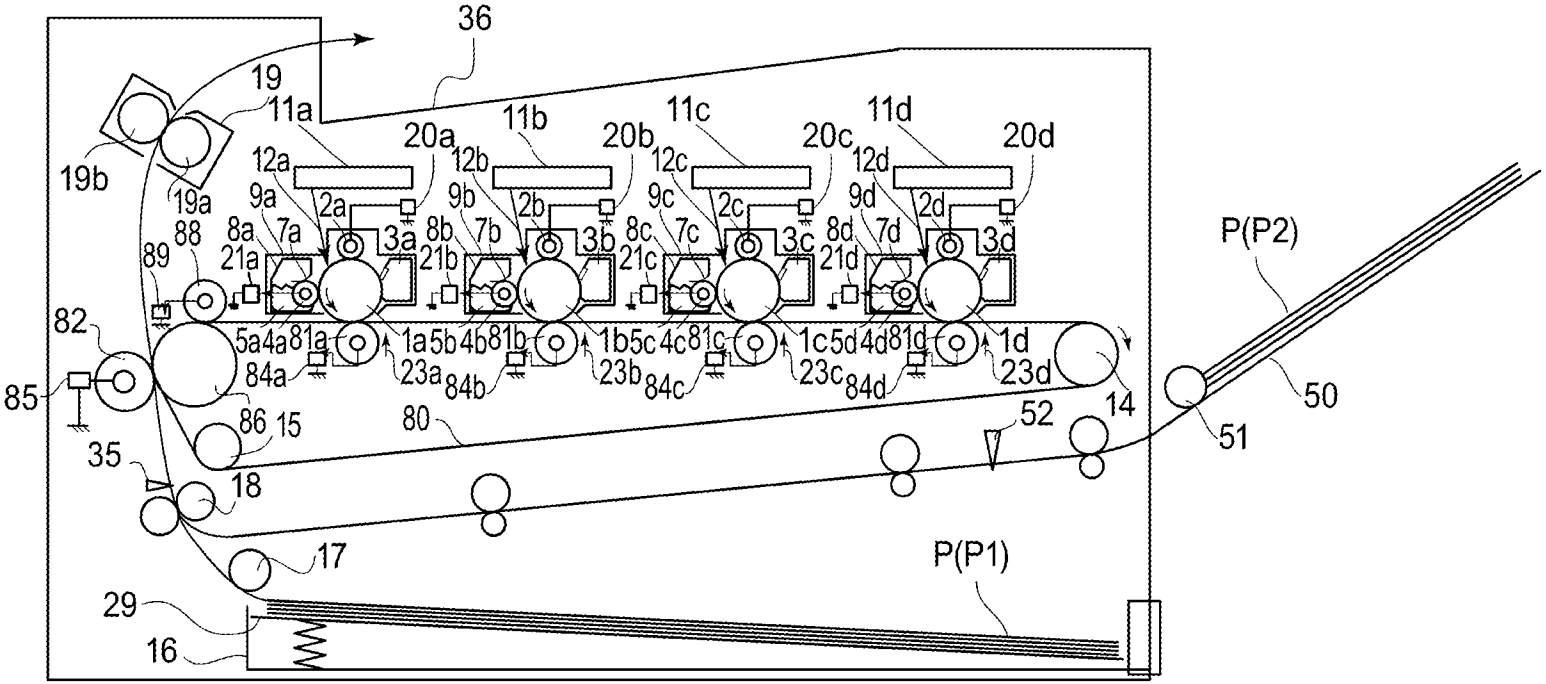
FIG. 1 is a cross-sectional drawing showing a configuration of an image forming apparatus according to Embodiments 1 through 3.

FIG. 1 shows the overall configuration of a laser beam printer as an example of an image forming apparatus according to Embodiment 1. The image forming apparatus shown in FIG. 1 has four image forming stations, from left to right in the figure, with yellow (Y), magenta (M), cyan (C), and black (Bk) toners. The a, b, c, and d at the end of the signs in the figure mean the components of the yellow (Y), magenta (M), cyan (C), and black (Bk) image forming stations, respectively. The configuration of each image forming station is identical, and in the following explanation, unless otherwise necessary, the a-d codes are omitted.

(Image Forming Portion)

At each image forming station, a photosensitive drum 1, which is an image bearing member, is driven by a driving motor (not shown) and is rotated in the direction of the arrow (counterclockwise) in the figure. A charging roller 2, which is a charging means, is in contact with the photosensitive drum 1 and charges the surface of the photosensitive drum 1 uniformly while it rotates driven by the rotation of the photosensitive drum 1. A superimposed DC or AC voltage is applied to the charging roller 2, and the photosensitive drum 1 is charged through a contact nip portion between the charging roller 2 and the surface of the photosensitive drum 1. A scanning portion 11, which is an exposure means, consists of a scanner unit or LED array in which a laser beam is deflected by a rotating polyhedral mirror and the deflected laser beam scans over the photosensitive drum 1. The scanning portion 11 irradiates a scanning beam 12 modulated based on video signals (image signals) onto the photosensitive drum 1 to form an electrostatic latent image. A developing unit 8, which is a developing means, consists of a developing roller 4, a developer (toner) 5, and a developer application blade 7 in contact with the photosensitive drum 1. The electrostatic latent image formed on the photosensitive drum 1 is developed by the toner to form a toner image. A waste toner container 3 collects the toner that remains on the photosensitive drum 1 without being transferred to an intermediate transfer belt 80, which will be explained later. A process cartridge 9 is an integrated cartridge that incorporates the photosensitive drum 1, charging roller 2, waste toner container 3, and developing unit 8, and can be detached from the image forming apparatus. The charging roller 2 and the developing roller 4 are connected to a charging voltage power supply 20, which is a voltage supply means to the charging roller 2, and a developing voltage power supply 21, which is a voltage supply means to the developing roller 4, respectively. The surface of the photosensitive drum 1 is uniformly charged by bringing the charging roller 2 into contact with the surface of the photosensitive drum 1 and applying a charging voltage to the charging roller 2 from the charging voltage power supply 20.

An intermediate transfer belt 80 is supported by three rollers, a secondary transfer opposing roller 86, a driving roller 14, and a tension roller 15, which are tensioning members, and is configured to maintain an appropriate tension. The driving roller 14 drives the intermediate transfer belt 80 moving at roughly the same speed in the direction of the arrow (clockwise direction) in the figure. A primary transfer roller 81 is located on the opposite side of the intermediate transfer belt 80 through the photosensitive drum 1 and is connected to a primary transfer voltage power supply 84, which is a means of supplying voltage to the primary transfer roller 81. Then, by applying primary transfer voltage to the primary transfer roller 81, the toner images on the photosensitive drum 1 (on the image bearing member) are sequentially transferred to the intermediate transfer belt 80 in contact with the photosensitive drum 1, forming a multicolor image on the intermediate transfer belt 80. Furthermore, a static eliminating member 23 is located downstream of each primary transfer roller 81 in the moving direction of the intermediate transfer belt 80. The driving roller 14, tension roller 15, static eliminating member 23*a*, and secondary transfer opposing roller 86 explained below are electrically grounded.

(Cassette Feeding Portion)

Paper P1, which is a recording material, is placed in a paper feeding cassette 16. When paper P1 (hereinafter referred to simply as "paper") is fed, a stepping motor (hereinafter referred to as "feeding motor") (not shown) drives a cassette pickup roller 17 to raise a feeding cassette bottom plate 29 and pushes up the paper P1 placed in the feeding cassette 16. The topmost sheet of paper P1 pushed up contacts a cassette pickup roller 17, and the rotation of the cassette pickup roller 17 separates and feeds the paper P1 one sheet at a time. The fed paper P1 is fed to a registration roller 18 (hereinafter referred to as "register roller 18"), which is a feeding means. Then, a registration sensor 35 (hereinafter referred to as "register sensor 35"), which is a recording material detecting means to detect the recording material, detects the leading end of the feeding direction of paper P1. Then, a driving motor (not shown) stops driving, and the feeding of the paper P1 is temporarily stopped. Paper P1, which is once stopped at the register roller 18, is fed (also called re-feeding) again at a timing such that the toner image formed on the intermediate transfer belt 80 and the position where the toner image on paper P1 is transferred (image forming position) match at the secondary transfer portion. The size of paper P1 (length of feeding direction, hereinafter referred to as "paper size") is determined based on the elapsed time from the timing (point in time) when paper P1 is re-fed to the timing (point in time) when the register sensor 35 detects the trailing end of the feeding direction of paper P1.

(MP Tray Feeding Portion)

A paper P2, which is a recording material, is stacked on an MP tray 50 (stacking unit). When paper P2 (hereinafter referred to simply as "paper") is fed, an MP tray pickup roller 51 (feeding roller) is driven by a feeding motor (not shown) as described above, and the topmost sheet of paper P2 is brought into contact with the MP tray pickup roller 51 and fed into the device. The fed paper P2 passes through an MP feeding sensor 52, which is a detection means in the feeding path, and is fed to the resist roller 18. After the paper is fed to the register roller 18, printing is performed according to the above-mentioned operation.

When continuously feeding paper (recording material) sequentially from the MP tray 50, subsequent paper feeding is performed after the MP feeding sensor 52 detects that the trailing end of the feeding direction of the preceding paper has passed.

(Secondary Transfer Portion)

The intermediate transfer belt 80, onto which the toner image formed on the photosensitive drum 1 at each image forming station is transferred, is moved in the direction of the arrow in the figure (clockwise direction) by a driving roller 14. The toner image transferred onto the intermediate transfer belt 80 is fed to the secondary transfer portion, which is the point of contact between a secondary transfer roller 82 and the intermediate transfer belt 80. The secondary transfer roller 82 and a secondary transfer opposing roller 86 installed opposite the secondary transfer roller 82 nip and feed the paper P and the intermediate transfer belt 80, and voltage is applied to the secondary transfer roller 82 from a secondary transfer voltage power supply 85. As a result, the toner image on the intermediate transfer belt 80 is transferred to the paper P.

(Fixing Portion)

A fixing portion 19, which is a fixing means, fixes the toner image on the paper P by applying heat and pressure to the toner image transferred on the paper P. The fixing portion 19 has a fixing belt 19*a* and a pressure roller 19*b*. The pressure roller 19*b* forms a fixing nip portion by nipping the fixing belt 19*a* with a belt guide member (not shown) by a predetermined pressure contact force. With the fixing nip portion temperature adjusted to the predetermined temperature, paper P on which the unfixed toner image has been transferred is introduced between the fixing belt 19*a* and the pressure roller 19*b* in the fixing nip portion with the image surface facing upward, that is, facing the fixing belt 19*a* surface. In the fixing nip portion, the image surface of the paper P adheres to the outer surface of the fixing belt 19*a*, and the paper P is nipped and fed between the fixing nip portion. In the process of paper P being nipped and fed between the fixing nip portion by the fixing belt 19*a*, the toner image on paper P is heated by the fixing belt 19*a* and fixed on paper P. The paper P with the fixed toner image is ejected onto an ejection tray 36.

[System Configuration of an Image Forming Apparatus]

Figure 2:
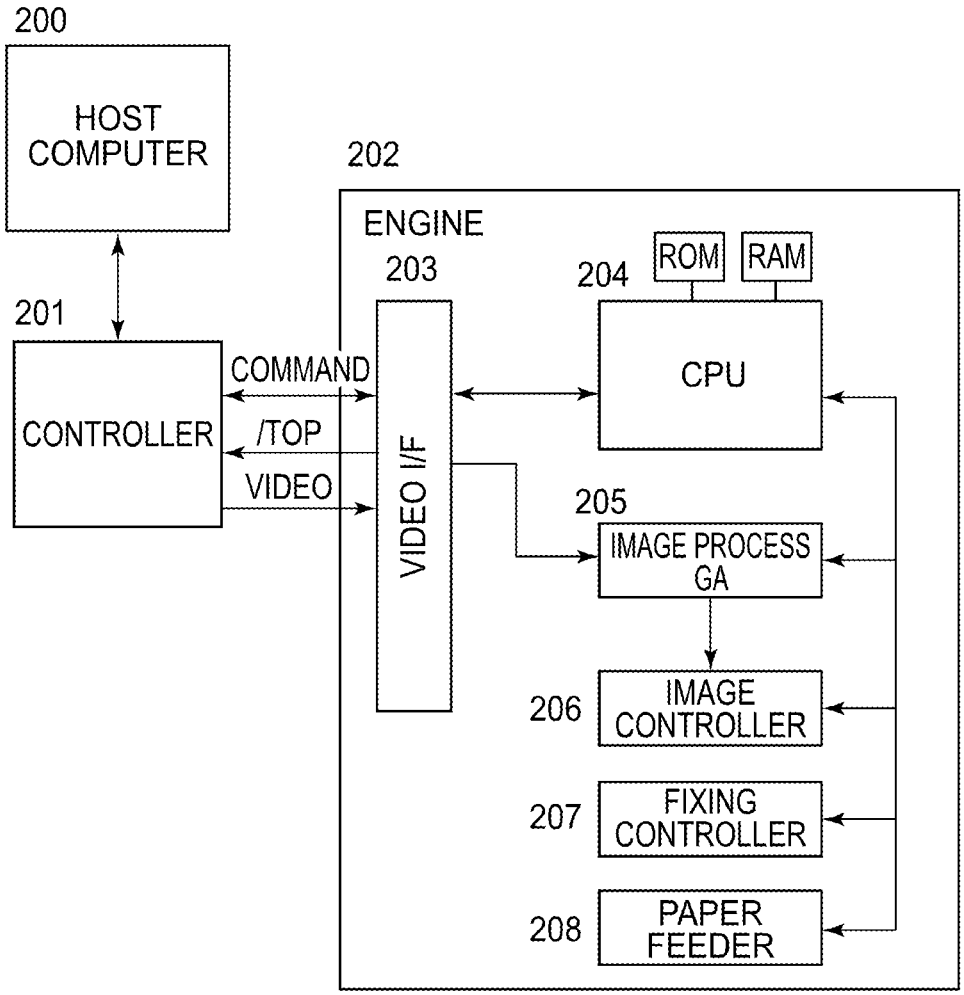
FIG. 2 is a block drawing showing a system configuration of an image forming apparatus according to Embodiments 1 through 3.

FIG. 2 is a block diagram explaining the overall system configuration of the present embodiment of the image forming apparatus. In FIG. 2, the image forming apparatus is equipped with a controller portion 201 and an engine portion 202. The controller portion 201 can communicate with a host computer 200 and the engine portion 202, which are external devices. The controller portion 201, which is a means of outputting image signals, receives printing orders including image information (printing data) and printing conditions from the host computer 200 and develops bitmap data (image data) based on the received printing data. When the controller portion 201 finishes expanding the bitmap data, it sends image size information and print reservation commands to a CPU 204 via a video interface portion 203, in accordance with the print order from the host computer 200. At the timing when the engine section 202 is ready to print (ready to form images), the controller portion 201 sends a print start command to the CPU 204.

The engine section 202, which is a control means, consists of a video interface portion 203, a CPU 204, an image processing GA (gate array) 205, an image control portion 206, a fixing portion 207, and a paper feeding portion 208. The CPU 204, image processing GA 205, image control portion 206, fixing control portion 207, and paper feeding portion 208 are connected via a bidirectional bus and send and receive data to and from each other via the bidirectional bus. The video interface portion 203 relays signals (commands, /TOP signals, and video signals) between the engine portion 202 and the controller portion 201.

The image control portion 206 controls each image forming station, which is the image forming portion described above.

The fixing control portion 207 controls the above-mentioned fixing portion 19, and the paper feeding portion 208 controls the above-mentioned cassette feeding portion and MP tray feeding portion.

The CPU 204, which sends and receives commands and other data from the controller portion 201, prepares to execute a print job when it receives a paper size specification command or print reservation command from the controller portion 201. The CPU 204 then waits for the controller portion 201 to send a print start command. When the CPU 204 receives a print start command, it instructs each control portion (image control portion 206, fixing portion 207, and paper feeding portion 208) to start printing operations based on the information in the print reservation command such as the specified paper size. The CPU 204 has a ROM and a RAM. The ROM stores control programs and data to be executed by the CPU 204, and the RAM is a memory used by the control programs executed by the CPU 204 to temporarily store information. The image control portion 206, paper feeding portion 208, etc. also have an unshown CPU, ROM, and RAM. Like the CPU 204, the ROM stores control programs and data, and the RAM is used by the control programs to temporarily store information.

When the image control portion 206 receives an instruction from the CPU 204 to start printing operation, it starts preparing for image formation. When the CPU 204 receives notification from the image control portion 206 that image formation preparation is complete, it outputs the/TOP signal, a timing signal that serves as the reference timing for outputting video signals, to the controller portion 201 via the video interface portion 203. When the controller portion 201 receives the/TOP signal from the CPU 204, it outputs the video signal (image signal) generated from the bitmap data to the image processing GA 205 for the specified paper size, based on the timing when the/TOP signal is received. When the image processing GA 205 receives a video signal from the controller portion 201, it converts the received video signal into data for image formation and sends it to the image control portion 206. The image control portion 206 performs image formation based on the data for image formation received from the image processing GA 205. In image forming for continuous printing, the image control portion 206 determines the image forming interval, which is the time interval (cycle) at which the/TOP signal is output, based on the paper size specified in the print reservation command received from the controller portion 201. The image control portion 206 then instructs the CPU 204 to send the/TOP signal in accordance with the determined image forming interval.

When the paper feeding portion 208 receives an instruction from the CPU 204 to start a printing operation, it starts a feeding operation to feed paper. The paper feeding portion 208 drives a paper feeding motor (not shown) to feed paper stacked in the MP tray 50 or feeding cassette 16 (hereinafter referred to as stacking unit) to the secondary transfer portion, and uses the register sensor 35 (FIG. 1) to detect the paper size of the fed paper. In the feeding control for continuous printing with paper placed in the MP tray 50, the paper feeding portion 208 feeds subsequent paper when the following two conditions are satisfied.

In other words, the paper feeding portion 208 controls the feeding of the subsequent paper feeding portion when a predetermined time has elapsed since the MP feeding sensor 52 detected the leading end of the preceding paper feeding direction and the MP feeding sensor 52 detects that the trailing end of the feeding direction of the preceding paper has passed. In the following, the paper fed following the preceding paper is referred to as the subsequent paper.

When the fixing control portion 207 receives an instruction from the CPU 204 to start printing operation, it starts preparing for the fixing process. Then, the fixing control portion 207 starts adjusting the temperature of the fixing portion 19 according to the paper type information (e.g., paper thickness) set in the print reservation command, in accordance with the timing when the paper on which the toner image has been transferred is fed to the fixing portion 19. After fixing the image (toner image) on the paper, the fixing control portion 207 feeds (ejects) the paper out of the device.

[Print Operation Overview]

Next, the printing operation when the paper size specified by the host computer 200 (designated size) and the paper size actually stacked in the MP tray 50 (specified size) are different when printing on paper fed from the MP tray 50 is explained.

Printing control in the present embodiment of the image forming apparatus shall be based on the following parameters. The image interval (the interval between the image signal and the next image signal) shall be 220 mm, and the paper interval (the distance between the preceding and subsequent paper) shall be 140 mm. The feeding speed (the speed at which the paper is fed and also the speed at which the image formed on photosensitive drum 1 moves) is 150 mm/s (150 mm per second). Furthermore, the MP tray pickup roller 51 is driven by the paper feeding motor (not shown), and the distance that the MP tray pickup roller 51 rotates before the paper placed on the MP tray 50 is moved by the MP tray pickup roller 51 is 60 mm. The distance from the leading end of the feeding direction of the paper stacked on the MP tray 50 to the position where the MP feeding sensor 52 is installed is 50 mm.

In the present embodiment of the image forming apparatus, the distance from the secondary transfer portion to the MP feeding sensor 52 is A, and the distance that the image formed at the image forming start position (the laser exposure position on the photosensitive drum 1 in the yellow station) travels to the secondary transfer portion is B. The relationship between distance A and distance B is: distance A distance B (distance A is less than or equal to distance B).

[Overview of Conventional Printing Operations]

Figure 3A:
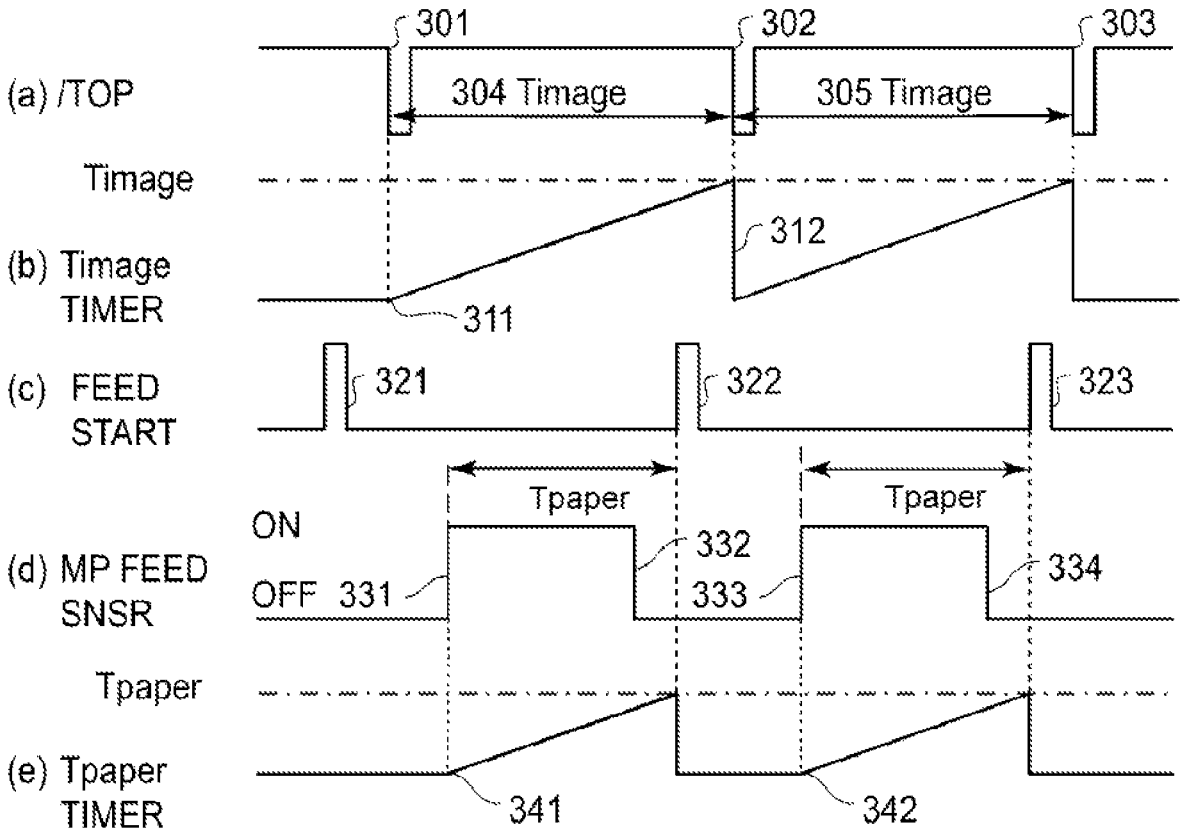
FIG.3A PRIOR ART
FIG. 3A and FIG. 3B are timing charts showing a conventional image forming control and feeding control for comparison with the embodiments.
Figure 3B:
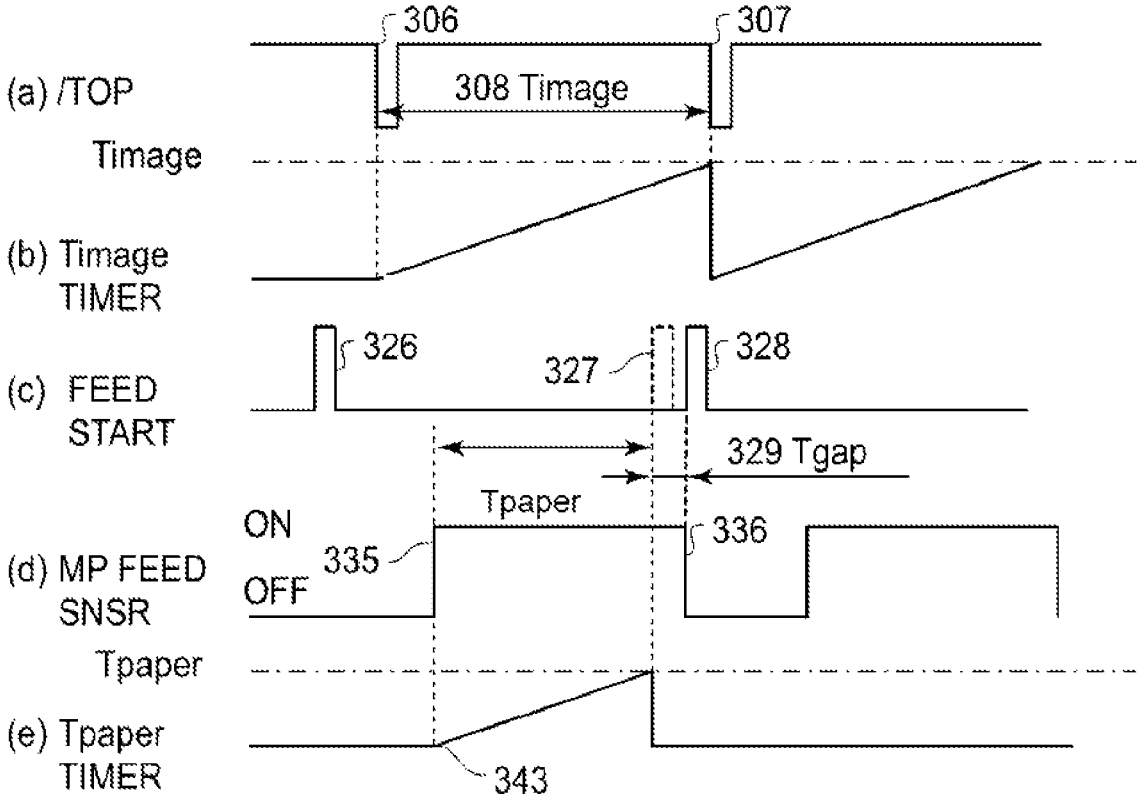
FIG.3B PRIOR ART

First, conventional image forming control and feeding control in an image forming apparatus are explained. FIGS. 3A, 3B show timing charts to explain the conventional image forming control and feeding control.

(When the Specified Size of the Paper is the Same as the Size of the Stacked Paper)

FIG. 3A is a timing chart that explains the image forming control and feeding control when both the specified paper size and the feeding size are the same and the paper width is 210 mm and the feeding direction length is 148 mm (A5 size horizontal paper). In FIG. 3A, the (a)/TOP signal indicates the signal that the engine portion 202 sends to the controller portion 201 when it receives notification from the image control portion 206 that it is ready to form images. Timage indicates the image forming interval (Timage) at which the/TOP signal is output, and (b) Timage timer indicates the change in the timer value of the timer that measures the image forming interval (Timage). (c) The feed start signal indicates when to drive the MP tray pickup roller 51 to feed the paper stacked in the MP tray 50. (d) MP feeding sensor indicates the detection status of the MP feeding sensor 52, which detects the paper fed from the MP tray 50. An ON status indicates that the paper is detected, while an OFF status indicates that the paper is not detected. (e) A Tpaper timer indicates the change in the timer value of the timer that measures the feed interval (Tpaper) of the paper fed from the MP tray 50. The feed interval (Tpaper) in the present embodiment is the time from when the MP feeding sensor 52 detects the leading end of the paper fed from the MP tray 50 until the feed start signal is formed. In FIG. 3A, the horizontal axis direction indicates time.

When the engine portion 202 receives a print start command from the controller portion 201, it instructs the image control portion 206, paper feeding portion 208, etc. to start the printing operation in order to perform image forming preparation operations for a printing operation. Upon receiving a notification from the image control portion 206 that the image formation preparation is complete, the engine portion 202 outputs a /TOP signal (301) for the first sheet of paper (first recording material) to the controller portion 201 ((a) of FIG. 3A). The Timage timer will then start at the timing (311) when the /TOP signal (301) is output ((b) of FIG. 3A). When the timer value of the timer reaches the image forming interval (Timage) ((b) of FIG. 3A), the engine portion 202 sends a /TOP signal (302) for the second sheet of paper (second recording material) to the controller portion 201 ((a) of FIG. 3A). In the same manner below, the Timage timer starts at the timing (312) when the /TOP signal (302) is output. When the timer value of the Timage timer reaches the image forming interval (Timage), the engine portion 202 outputs the /TOP signal (303) for the third sheet of paper to the controller portion 201.

The image forming interval Timage in FIG. 3A is expressed by the following (Formula 1).

image forming interval *T*image=(length of feeding direction of specified size of paper+image interval)/feeding speed (Formula 1)

In the present embodiment, the image forming interval Timage is (length of the feeding direction of the specified size of the paper (148 mm)+image interval (220 mm))/150 mm/s=368 mm/150 mm/s≈2.453 s (seconds).

Meanwhile, when the engine portion 202 completes the feeding preparation operation, it drives the MP tray pickup roller 51 to feed one sheet of paper from the MP tray 50 at the timing of the feeding start signal (321) ((c) of FIG. 3A). When the MP feeding sensor 52 detects the leading end of the feeding direction of the paper feeding portion fed from the MP tray 50 at timing (331) ((d) of FIG. 3A), the engine portion 202 starts the Tpaper timer at timing (341) ((e) of FIG. 3A). The engine portion 202 detects that the timer value of the Tpaper timer has reached the feed interval (Tpaper) ((e) of FIG. 3A) and that the MP feeding sensor 52 has passed the trailing end of the feeding direction of the preceding paper feeding portion at timing (332) ((d) of FIG. 3A). Then, at the timing of the feeding start signal (322) ((c) of FIG. 3A), the engine portion 202 drives the MP tray pickup roller 51 to feed one subsequent sheet of paper (second sheet) from the MP tray 50. In the same manner, when the MP feeding sensor 52 detects the leading end of the subsequent sheet fed from the MP tray 50 at timing (333), the Tpaper timer starts at timing (342). The engine portion 202 detects at timing (334) that the timer value of the Tpaper timer has reached the feed interval (Tpaper) and the MP feeding sensor 52 has passed the trailing end of the preceding paper. Then, the engine portion 202 drives the MP tray pickup roller 51 at the timing of the feeding start signal (323) to feed one subsequent sheet of paper (the third sheet) from the MP tray 50.

The feed interval Tpaper in FIG. 3A is expressed by the following (Formula 2) based on (c) and (d) of FIG. 3A.

feed interval *T*paper=(Stacking size+paper interval−distance that paper rotates from the time MP tray pickup roller 51 is driven until it starts moving−distance from the leading end of the paper stacked on MP tray 50 to MP feeding sensor 52)/feeding speed (Formula 2)

In the present embodiment, the stacked size (the length of the feeding direction of the paper placement size) is 148 mm and the paper interval is 140 mm. As mentioned above, the distance that the MP tray pickup roller 51 rotates from the time it is driven until the paper starts moving is 60 mm, and the distance from the leading end of the paper placed on the MP tray 50 to the position where the MP feeding sensor 52 is installed is 50 mm. Therefore, from (Formula 2), the feed interval Tpaper is (148 mm+140 mm−60 mm−50 mm)/150 mm/s=178 mm/150 mm/s≈1.187 s.

(When the Specified Size of the Paper does not Match the Size of the Stacked Paper)

FIG. 3B is a timing chart that explains the image forming control and feeding control in the case of a mismatch between the specified size of paper and the size of the paper. In FIG. 3B, the specified paper size is A5 size horizontal paper (210 mm wide×148 mm long in the feeding direction), and the paper stacked size is A5 size vertical paper (148 mm wide×210 mm long in the feeding direction). The A5 size paper stacked in the MP tray 50 is placed vertically, so the length of the feeding direction of the paper is larger than that of the specified size. The configuration of FIG. 3B is the same as that of FIG. 3A explained above, and the explanation of how to view the figure is omitted.

In FIG. 3B, when forming images consecutively, the engine portion 202, as in FIG. 3A, outputs the/TOP signal (306), then, after the image forming interval Timage has passed, /TOP signal (307) for the second sheet of paper is output.

On the other hand, with respect to feeding operations, as explained in FIG. 3A, the engine portion 202 feeds one sheet of paper from the MP tray 50 at the timing of the feed start signal (326) ((c) of FIG. 3B), prior to the image forming operation. When MP feeding sensor 52 detects the leading end of the feeding direction of the paper feeding portion fed from the MP tray 50 at timing (335) ((d) of FIG. 3B (d)), engine portion 202 starts the Tpaper timer at timing (343) ((e) of FIG. 3B (e)). The timer value of the Tpaper timer reaches the feed interval (Tpaper) ((e) of FIG. 3B), but because the MP feeding sensor 52 has not detected the passage of the trailing end of the preceding paper ((d) of FIG. 3A), the feed start signal (327) is not generated ((c) of FIG. 3B). Then, when the MP feeding sensor 52 detects that the trailing end of the feeding direction of the preceding paper has passed at timing (336) ((d) of FIG. 3B), a feed start signal (328) is generated after a delay of Tgap (329) than usual ((c) of FIG. 3B).

The shortest paper interval between the preceding paper and the subsequent paper is expressed by the following (Formula 3) when the feeding operation of the subsequent paper is performed immediately after the trailing end of the preceding paper (leading paper) passes through the MP feeding sensor 52.

Minimum paper interval=distance that the MP tray pickup roller 51 rotates from the time it is driven until the paper starts to move+distance from the leading end of the paper in the MP tray 50 to the MP feeding sensor 52 (Formula 3)

In the present embodiment, the minimum paper interval is 60 mm+50 mm=110 mm.

Therefore, the time Tgap (319) shown in (d) of FIG. 3B is expressed by the following (Formula 4).

Time *T*gap=(feed interval in FIG. 3*B*−feed interval in FIG. 3*A*)/feeding speed (Formula 4)

In the present embodiment, the feed interval in FIG. 3B is the length of the feeding direction of the paper stacked size (210 mm)+the minimum paper interval (110 mm). On the other hand, the feed interval in FIG. 3A is the length of the feeding direction of the specified size of the paper (148 mm)+the paper spacing (140 mm). As a result, the time Tgap is ((210 mm+110 mm)−(148 mm+140 mm))/150 mm/s=32 mm/150 mm/s 0.213 s (seconds). The image forming interval Timage remains the same in FIGS. 3A, 3B, but the feed interval is 0.213 s (seconds) slower in FIG. 3B than in FIG. 3A, which is the normal state. In other words, in the case of FIG. 3B, in response to the/TOP signal (307), the paper fed from the MP tray 50 is fed 0.213 s (seconds) later than in the case of FIG. 3A in the normal state.

As described above, if a mismatch occurs between the length of paper in the feeding direction of the specified size and the stacked size, and the length of the stacked size is longer than the specified size, the feeding margin for the paper feeding interval relative to the image forming interval is reduced, and the possibility of feeding malfunctions such as jams is increased. When a jam occurs, the toner image formed in the image forming portion is wasted, and the used toner becomes waste toner and is collected in the waste toner container. As the number of jams increases, the risk of the waste toner container overflowing increases. The "feeding margin" refers to the time margin that allows normal printing without causing jams or other feeding malfunctions, even if the fed paper is delayed for some reason.

Overview of the Present Embodiment's Printing Operation

In the present embodiment, as explained in FIG. 3B, the following controls are used to prevent a situation in which the feeding margin is cut off when a size mismatch between the specified size and the stacked size occurs. That is, in the paper feeding operation in continuous printing, the feed interval between the preceding and subsequent paper is larger than the feed interval calculated by replacing the stacked size with the specified size in (Formula 2) above. In such a case, the feed interval and the image forming interval shall be increased to the specified interval. In the present embodiment, the "predetermined interval" is defined as the same interval as when A4 size paper is used. A4 size paper is the largest size paper that is frequently used by users and is most likely to be stacked in the MP tray 50. Therefore, in the present embodiment, the size of the paper as the predetermined interval was determined to be A4 size, also taking into consideration the need to reduce the significant loss of productivity due to jams etc.

Figure 4:
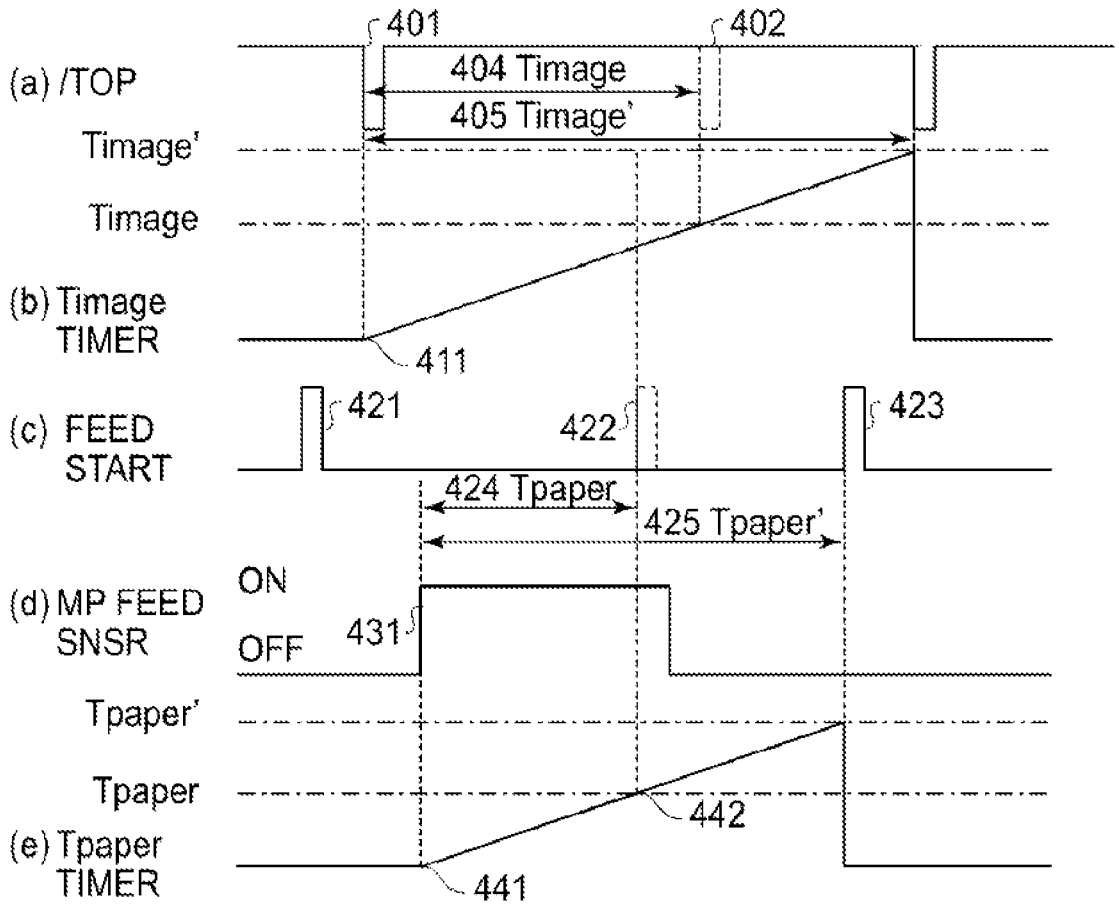
FIG. 4 is a timing chart showing image forming control and feeding control according to Embodiment 1.

FIG. 4 is a timing chart explaining the image forming control and feeding control in the present embodiment. In FIG. 4, as in FIG. 3B above, the specified size of the paper is A5 size paper (width 210 mm×length 148 mm in feeding direction) in horizontal orientation. The stacked size of the paper placed on the MP tray 50 is assumed to be A5 size vertical paper (148 mm wide×210 mm long in the feeding direction). The configuration of FIG. 4 is the same as that of FIG. 3A, 3B above, and the explanation of how to look at FIG. 4 is omitted.

When the engine portion 202 receives a print start command from the controller portion 201, it instructs the image control portion 206, paper feeding portion 208, etc. to start the printing operation in order to perform image forming preparation operations for the printing operation. Upon receiving a notification from the image control portion 206 that image formation preparation is complete, the engine portion 202 outputs the/TOP signal (401) for the first sheet of paper to the controller portion 201 (part (a) of FIG. 4). The Timage timer starts at the timing (411) when the reference/TOP signal (401) is output (part (b) of FIG. 4). The engine portion 202 controls the engine portion so that the image forming interval is the image forming interval Timage (404) corresponding to the specified size of the paper. When the timer value of the Timage timer reaches Timage (404) (part (b) of FIG. 4), the engine portion 202 outputs the/TOP signal (402) for the second sheet of paper to the controller portion 201 if the stacked size of the paper is the same as the specified size (part (a) of FIG. 4). The image forming interval Timage in FIG. 4 can be obtained using (Formula 1) described in FIG. 3.

Meanwhile, when the feeding preparation operation is completed, the engine portion 202 drives the MP tray pickup roller 51 to feed one sheet of paper from the MP tray 50 at the timing of the feed start signal (421) (part (c) of FIG. 4). The engine portion 202 controls the feeding portion of subsequent sheets of paper while ensuring that the desired feed interval is the feed interval Tpaper (424) corresponding to the same stacked size as the specified size of the paper. As explained in FIG. 3, the fed interval Tpaper is controlled based on the timing when the MP feeding sensor 52 detects the leading end of the preceding paper. When the MP feeding sensor 52 detects the leading end of the paper feeding portion fed from the MP tray 50 at timing (431) (part (b) of FIG. 4), the engine portion 202 starts the Tpaper timer at timing (441) (part (e) of FIG. 4). The feed interval Tpaper (424) in FIG. 4 is the feed interval when A5-size horizontal paper similar to the specified size is fed from the MP tray 50, and can be obtained using (Formula 2) described in FIGS. 3A and 3B.

The engine portion 202 checks the status of the MP feeding sensor 52 at the timing when the timer value of the Tpaper timer reaches the feed interval Tpaper (424) (part (e) of FIG. 4). In the present embodiment, feed control (setting of feed interval Tpaper (424)) is performed assuming that A5 size paper is stacked in the MP tray 50 in a horizontal position. However, since the A5 size paper actually stacked in the MP tray 50 is placed vertically, the length of the feeding direction of the paper being fed from the MP tray is 210 mm. On the other hand, the numerator of (Formula 2) above, which calculates the feed interval Tpaper (424), is 178 mm (=148 mm+140 mm−60 mm-50 mm), which is shorter than the length of the A5 portrait orientation feed direction of 210 mm. Therefore, when the timer value of the Tpaper timer reaches the feed interval Tpaper (424) (i.e., when the predetermined time has elapsed), the trailing end of the feeding direction of the preceding paper has not yet passed the MP feeding sensor 52.

If the stacked size of the paper is the same as the specified size, when the timer value of the Tpaper timer reaches the feed interval Tpaper (424), the trailing end of the feeding direction of the preceding paper (leading paper) has passed the MP feed sensor 52 (part (d) of FIG. 4). Therefore, the engine portion 202 generates a feed start signal (422) to feed the subsequent paper (part (c) of FIG. 4).

On the other hand, if the engine portion 202 determines that the trailing end of the preceding paper has not passed the MP feeding sensor 52 at the timing (442) when the timer value of the Tpaper timer reaches the feed interval Tpaper (424), the feed interval is changed from Tpaper to Tpaper'. In other words, the engine portion 202 switches the feed interval for feeding subsequent paper from the MP tray 50 from feed interval Tpaper (424) for A5-size landscape paper to feed interval Tpaper' (425) in the case of A4-size portrait paper. When the timer value of the Tpaper timer reaches the feed interval Tpaper' (425), the engine portion 202 generates a feed start signal (423), drives the MP tray pickup roller 51, and feeds the subsequent paper.

The feed interval Tpaper' in FIG. 4 is expressed by the following (Formula 5).

Feed interval *T*paper'=(*A*4 size+paper interval−distance that the MP tray pickup roller 51 rotates from the time it is driven until the paper starts moving−distance from the leading end of the paper on the MP tray 50 to the MP feed sensor 52)/feeding speed (Formula 5)

In the present embodiment, the A4 size (length of the feeding direction of A4 size paper) is 297 mm and the paper interval is 140 mm. As mentioned above, the distance that the MP tray pickup roller 51 rotates from the time it is driven until the paper starts moving is 60 mm, and the distance from the leading end of the paper on the MP tray 50 to the MP feeding sensor 52 is 50 mm. Therefore, from (Formula 5), the feed interval Tpaper' is (297 mm+140 mm−60 mm−50 mm)/150 mm/s=327 mm/150 mm/s=2.180 s (seconds).

When the engine portion 202 determines that the preceding paper has not passed the MP feeding sensor 52 at the timing (442) when the timer value of the Tpaper timer reaches the feed interval Tpaper (424), the feed interval is switched from Tpaper to Tpaper'. At the same time that the engine portion 202 switches the feed interval from Tpaper (424) to Tpaper' (425), it also switches the image forming interval from Timage (404) to Timage' (405).

The image forming interval Timage' in FIG. 4 is expressed by the following (Formula 6).

Image forming interval *T*image'=(*A*4 size+image interval)/feeding speed (Formula 6)

In the present embodiment, the A4 size (length of the feeding direction of A4 size paper) is 297 mm and the image interval is 220 mm. Therefore, from (Formula 6), the image forming interval Timage' is (297 mm+220 mm)/150 mm/s=517 mm/150 mm/s≈3.447 s (seconds).

[Control Sequence for Image Forming Control and Feed Control]

Figure 5A:
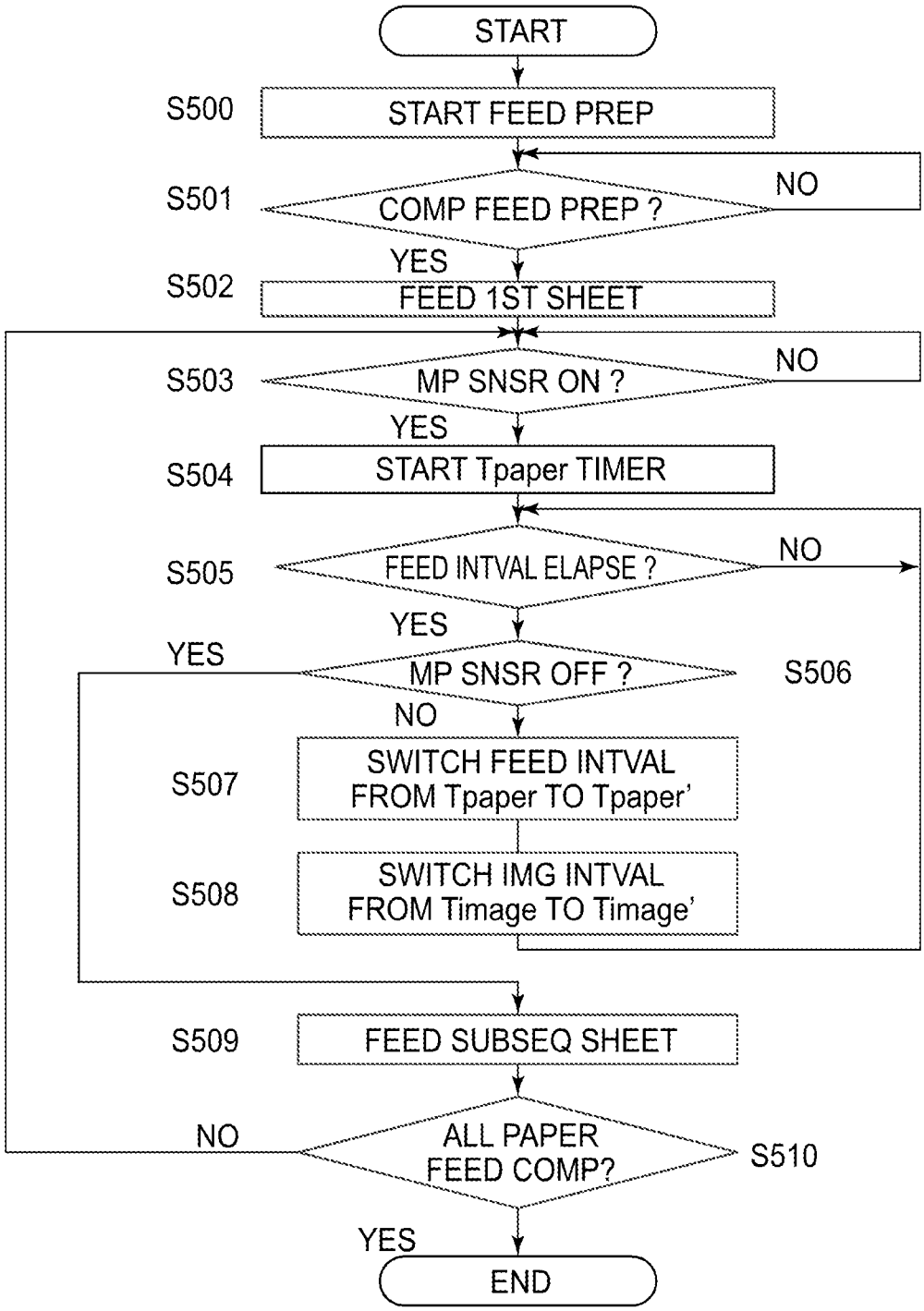
FIG. 5A and FIG. 5B are flowcharts showing a control sequence of image forming control and feeding control according to Embodiment 1.
Figure 5B:
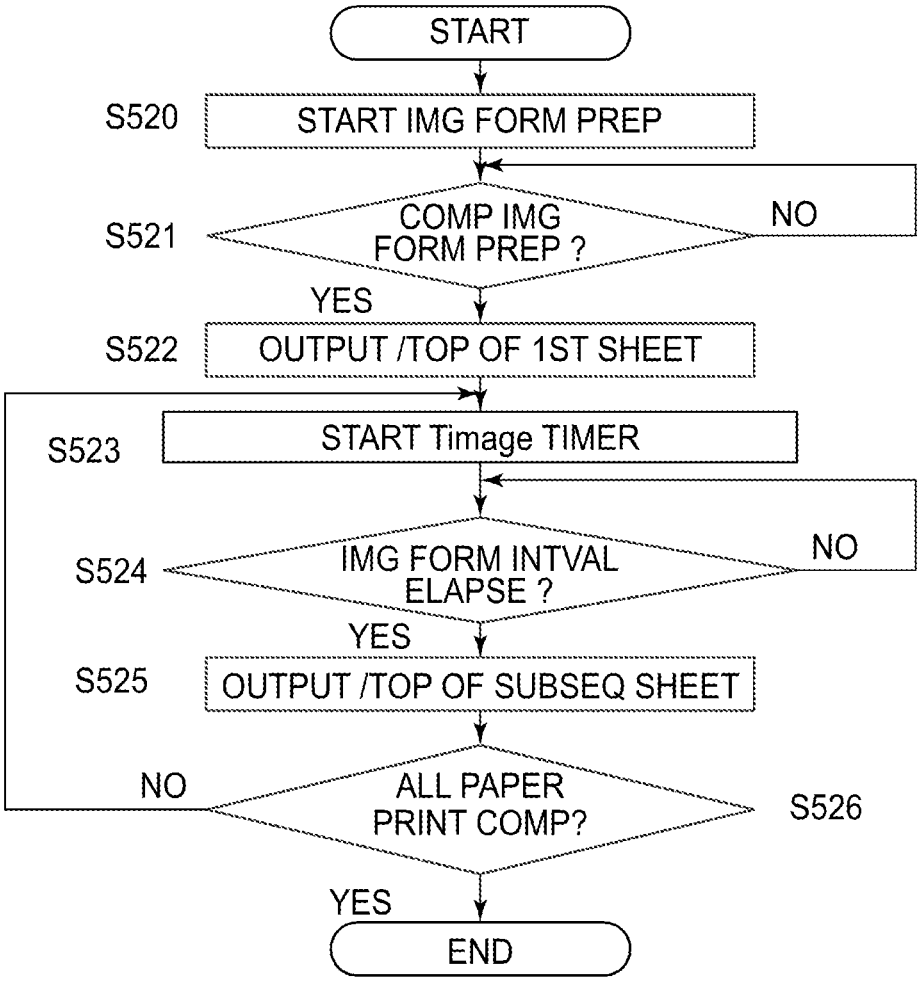

FIGS. 5A and 5B are flowcharts showing a control sequence of image forming control and feeding control in the present embodiment. FIG. 5A is a flowchart showing the control sequence of the feeding control of the paper stacked on the MP tray 50, and FIG. 5B is a flowchart showing the control sequence of the image forming control that performs image forming on the fed paper. The processes shown in FIGS. 5A and 5B are started when the engine portion 202 receives a print start command from the controller portion 201, and are executed by the engine portion 202. It is assumed that the engine portion 202 has received the image size information, paper size specification command, and print reservation command from the controller portion 201 before receiving the print start command.

(Control Sequence of Feed Control)

The control sequence of feed control of paper stacked in the MP tray 50, shown in FIG. 5A, is described below. In step (hereinafter referred to as "S") 500, the engine portion 202 starts feeding preparation operation upon receiving a print start command from the controller portion 201. At S501, the engine portion 202 determines whether the feeding preparation of the paper stacked on the MP tray 50 is complete. If the engine portion 202 determines that feeding preparation is complete, it proceeds to S502, and if it determines that feeding preparation is not complete, it returns the process to S501.

In S502, the engine portion 202 drives the MP tray pickup roller 51 to feed one sheet (first sheet) of paper stacked on the MP tray 50. In S503, the engine portion 202 acquires the paper detection status of the MP feeding sensor 52 and, based on the acquired detection status (detection result), determines whether the MP feeding sensor 52 has detected the leading end of the feeding direction of the paper fed from the MP tray 50 (MP feeding sensor on?). If the acquired detection status of the MP feeding sensor 52 is ON, the engine portion 202 concludes that the MP feeding sensor 52 has detected the leading end of the fed paper and advances the process to S504. On the other hand, if the detection state of the acquired MP feeding sensor 52 is not ON (it is OFF), the engine portion 202 concludes that the MP feeding sensor 52 is not detecting the fed paper, and returns the process to S503.

In S504, the engine portion 202 calculates the feed interval Tpaper using the above-mentioned (Formula 2) based on the paper size specified by the paper size specification command, and also resets and starts the Tpaper timer that measures the feed interval. In S505, the engine portion 202 refers to the Tpaper timer to determine whether the feed interval has elapsed. If the engine portion 202 determines that the feed interval has passed based on the timer value of the Tpaper timer, it proceeds to S506, and if it determines that the feed interval has not passed, it returns the process to S505.

In S506, the engine portion 202 acquires the paper detection status of the MP feeding sensor 52 and determines whether the trailing end of the feeding direction of the paper fed from the MP tray 50 has passed the MP feeding sensor 52 (MP feeding sensor off?). If the detection state of the acquired MP feeding sensor 52 is OFF, the engine portion 202 concludes that the trailing end of the fed paper has passed through the MP feeding sensor 52, and proceeds to S509. On the other hand, if the detection state of the acquired MP feeding sensor 52 is not in the OFF state (it is ON), the engine portion 202 concludes that the trailing end of the fed paper has not passed through the MP feeding sensor 52, and proceeds to S507.

In S507, the engine portion 202 concludes that the size of the fed paper from the MP tray 50 is larger than the paper size specified by the paper size specification command. Then, the engine portion 202 switches the feed interval from the feed interval Tpaper corresponding to the paper size specified by the paper size specification command to the feed interval Tpaper corresponding to the A4 size paper, which is calculated using the above-mentioned (Formula 5). In S508, the engine portion 202 switches the image forming interval from Timage, which is based on the image size information, to the image forming interval Timage', which is based on A4 size paper, calculated using the above-mentioned (Formula 6). Then, the engine portion 202 returns the process to S505.

In S509, the engine portion 202 drives the MP tray pickup roller 51 to feed one sheet of paper (subsequent paper) stacked on the MP tray 50.

At S510, the engine portion 202 concludes whether feeding of all the paper has been completed based on the print reservation command for the subsequent paper. If the engine portion 202 receives a print reservation command, it concludes that the paper feeding is not finished and returns the process to S503. On the other hand, if the engine portion 202 has not received a print reservation command, it concludes that feeding of all paper has been completed and the process is terminated.

(Control Sequence of Image Forming Control)

A control sequence of image forming control, which forms an image on a fed paper, as shown in FIG. 5B, is described. In S520, the engine portion 202 receives a print start command from the controller portion 201 and starts the image forming preparation operation. At S521, the engine portion 202 concludes whether the image forming preparation is complete. If the engine portion 202 concludes that the image forming preparation is complete, it proceeds to S522, and if it concludes that the image forming preparation is not complete, it returns the process to S521. In S522, the engine portion 202 outputs the /TOP signal for the first sheet of paper to the controller portion 201 and starts image formation.

In S523, the engine portion 202 calculates the image forming interval Timage using the above-mentioned (Formula 1) based on the image size information received from the controller portion 201. At the same time, the Timage timer that measures the image forming interval is reset and started. In S524, the engine portion 202 refers to the Timage timer and concludes whether the image forming interval has elapsed. If the engine portion 202 concludes that the image forming interval has elapsed based on the timer value of the Timage timer, it proceeds to S525, and if it concludes that the image forming interval has not elapsed, it returns the process to S524.

In S525, the engine portion 202 outputs a /TOP signal to the controller portion 201 for the next paper (subsequent paper) and starts image formation. In S526, the engine portion 202 concludes whether the printing of all the paper has been completed based on the print reservation command for the subsequent paper. If the engine portion 202 receives a print reservation command, it concludes that printing of the paper has not been completed and returns the process to S523. On the other hand, if the engine portion 202 has not received any print reservation commands, it concludes that printing of all the paper has been completed and terminates the process.

In S523, the image forming interval Timage is calculated based on the image size information received from the controller portion 201. However, if there is a mismatch between the specified paper size and the size of the paper fed from the MP tray 50, the above-mentioned S508 process switches the image forming interval is switched from Timage to the image forming interval Timage' corresponding to the A4 size paper. As a result, the image forming interval of the Timage timer may be switched from Timage to Timage' according to the paper size fed from the MP tray 50. This prevents a decrease in the feeding margin of the paper fed from the MP tray 50 and suppresses the occurrence of feeding malfunctions such as jams. It can also reduce the risk of the waste toner container overflowing due to collection of waste toner as a result of a jam.

In the present embodiment, a control is explained that, in the case of a mismatch between the specified size and the stacked size of the paper, the image forming interval and the feed interval are expanded to the same as the feed interval of an A4 size paper. In the present embodiment, the feed interval to be expanded is the A4 feed interval, but this is not limited to A4. For example, the maximum paper size supported by the image forming apparatus or the paper size frequently used by the user may be used as a standard. The present embodiment also explains the case where paper of a size different from the specified size is placed in the MP tray 50, but this is not the only case where a paper size mismatch can occur. For example, even if the paper of the specified size is actually placed on the MP tray 50, the MP feeding sensor 52 cannot detect the leading end and trailing end of each paper, even if the fed paper is overlapped (a state in which multiple papers are fed in a row (overlapped)). Therefore, it may be concluded that there is a paper size mismatch, and the same control as for a paper size mismatch is performed in the present embodiment.

As explained above, the present embodiment can suppress the occurrence of feeding malfunctions of paper due to paper size mismatch.

Embodiment 2

Embodiment 1 explains a control that enables successful feeding by increasing the feed interval and image forming interval to the specified size+paper interval when the feed interval between the preceding and subsequent paper is found to be greater than the specified size+paper interval in continuous printing of paper fed from the MP tray. Embodiment 2 explains a control that feeds the subsequent paper according to the paper size by determining the start of feed and image formation based on the MP feed sensor's detection of the passage of the trailing end of the preceding paper when a paper size mismatch occurs. The configuration of the image forming apparatus and system configuration of the present embodiment are the same as those of Embodiment 1, and the same symbols are used for the same devices and components to omit the explanation.

Overview of Printing Operation of the Present Embodiment

Figure 6:
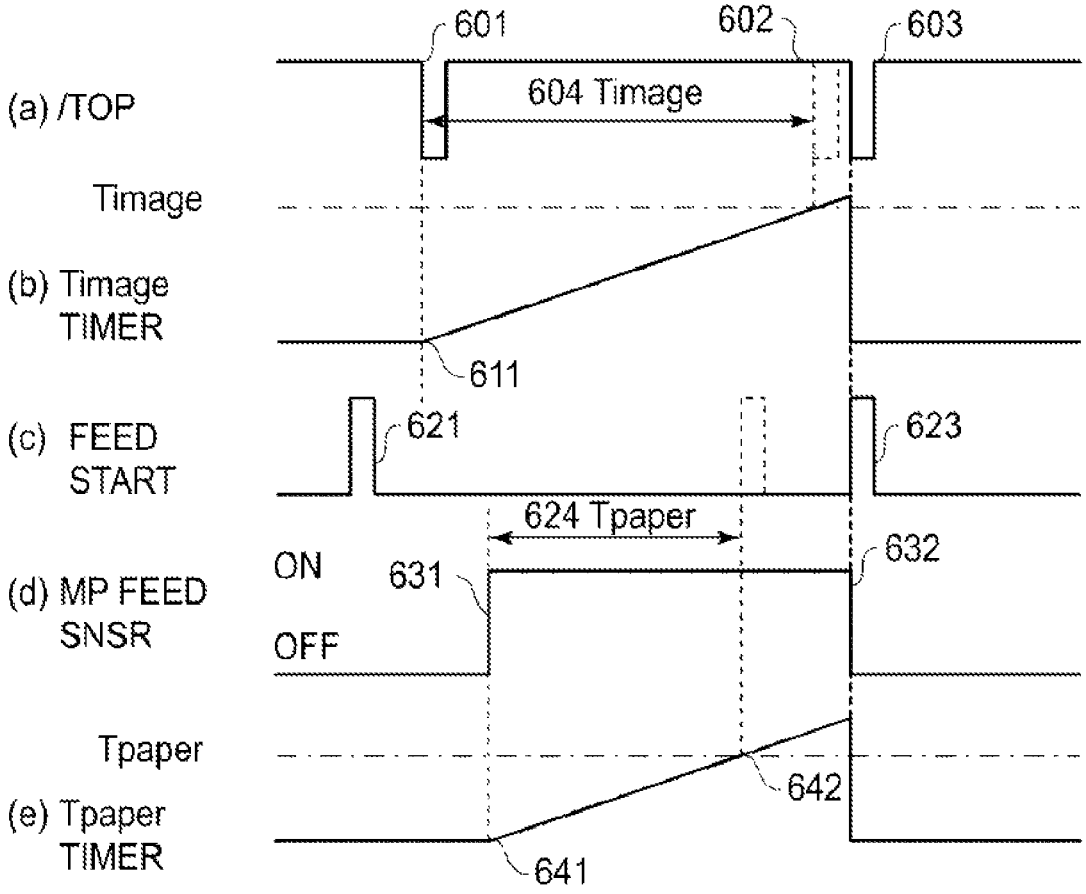
FIG. 6 is a timing chart showing image forming control and feeding control according to Embodiment 2.

FIG. 6 is a timing chart that explains the image forming control and feed control in the present embodiment. In FIG. 6, the specified size of the paper is A5 size horizontal paper (210 mm wide×148 mm long in the feeding direction). On the other hand, the stacked size of the paper stacked in the MP tray 50 is LTR (letter) paper (paper width 215.9 mm×feeding direction length 279.4 mm), and the specified size and stacked size of the paper do not match, and the feeding direction of the paper stacked in the MP tray 50 is longer. The parameters used in the image forming apparatus and printing control are the same as in Embodiment 1. The configuration of FIG. 6 is the same as that of FIG. 4 of Embodiment 1 described above, and the explanation of how to view FIG. 6 is omitted.

When the engine portion 202 receives a print start command from the controller portion 201, it instructs the image control portion 206, paper feeding portion 208, etc. to start the print operation in order to perform image forming preparation operation for the print operation. Upon receiving notification from the image control portion 206 that image forming control is ready, the engine portion 202 outputs the /TOP signal (601) for the first sheet of paper to the controller portion 201 (part (a) of FIG. 6). The Timage timer starts at the timing (611) when the reference /TOP signal (601) is output (part (b) of FIG. 6). The engine portion 202 controls the image forming interval so that the image forming interval is the image forming interval Timage (604) according to the specified size of the paper. When the timer value of the Timage timer reaches Timage (604) (part (b) of FIG. 6), the engine portion 202 outputs the /TOP signal (602) for the second sheet of paper to the controller portion 201 if the stacked size of the paper is the same as the specified size (part (a) of FIG. 6). The image forming interval Timage in FIG. 6 can be calculated using (Formula 1) explained in FIG. 3 of Embodiment 1.

Meanwhile, when the engine portion 202 completes the feeding preparation operation, it drives the MP tray pickup roller 51 to feed one sheet of paper from the MP tray 50 at the timing of the feed start signal (621) (part (c) of FIG. 6). The engine portion 202 controls the feeding of the subsequent paper while ensuring that the desired feed interval is the feed interval Tpaper (624), which corresponds to the same stacked size as the specified size of the paper. As in Embodiment 1, the feed interval Tpaper is controlled based on the timing when the MP feeding sensor 52 detects the leading end of the preceding paper. When the MP feeding sensor 52 detects the leading end of the feeding direction of the paper fed from the MP tray 50 at timing (631) (part (d) of FIG. 6), the engine portion 202 starts the Tpaper timer at timing (641) (part (e) of FIG. 6). The feed interval Tpaper (624) in FIG. 4 is the feed interval when A5 size horizontal paper similar to the specified size is fed from the MP tray 50. It can be calculated using the (Formula 2) explained in FIGS. 3A and 3B of Embodiment 1.

The engine portion 202 checks the status of the MP feeding sensor 52 when the timer value of the Tpaper timer reaches the feed interval Tpaper (624) (part (e) of FIG. 6). In the present embodiment, feed control (setting of feed interval Tpaper (624)) is performed assuming that A5 size paper is stacked in the MP tray 50 in horizontal position. However, the paper actually stacked in the MP tray 50 is LTR (letter) paper (paper width 215.9 mm×feeding direction length 279.4 mm), which is longer than the feeding direction length of 148 mm for A5 size horizontal paper. Therefore, at the timing (642) when the timer value of the Tpaper timer reaches the feed interval Tpaper (624), the trailing end of the feeding direction of the preceding paper has not yet passed the MP feeding sensor 52.

Therefore, if the engine portion 202 concludes that the trailing end of the feeding direction of the preceding paper has not passed the MP feeding sensor 52 at timing (642), the engine portion 202 prohibits image formation and feeding of the subsequent paper. Since the engine portion 202 prohibits image formation on the subsequent paper, it does not output the/TOP signal (602) and does not start image formation on the subsequent paper even when the Timage timer reaches the image forming interval Timage (604). The engine portion 202 then permits image formation and feeding of the subsequent paper when the MP feeding sensor 52 detects the passage of the trailing end of the feeding direction of the paper fed from the MP tray 50 (preceding paper) at timing (632) (part (d) of FIG. 6). As a result, the engine portion 202 outputs a/TOP signal (603) for the second sheet of paper (sub sequent paper) to the controller portion 201 at timing (632) (part (a) of FIG. 6). The engine portion 202 also drives the MP tray pickup roller 51 and feeds one sheet of the subsequent paper from the MP tray 50 at the timing of the feeding start signal (623).

[Control Sequence for Image Forming Control and Feed Control]

Figure 7A:
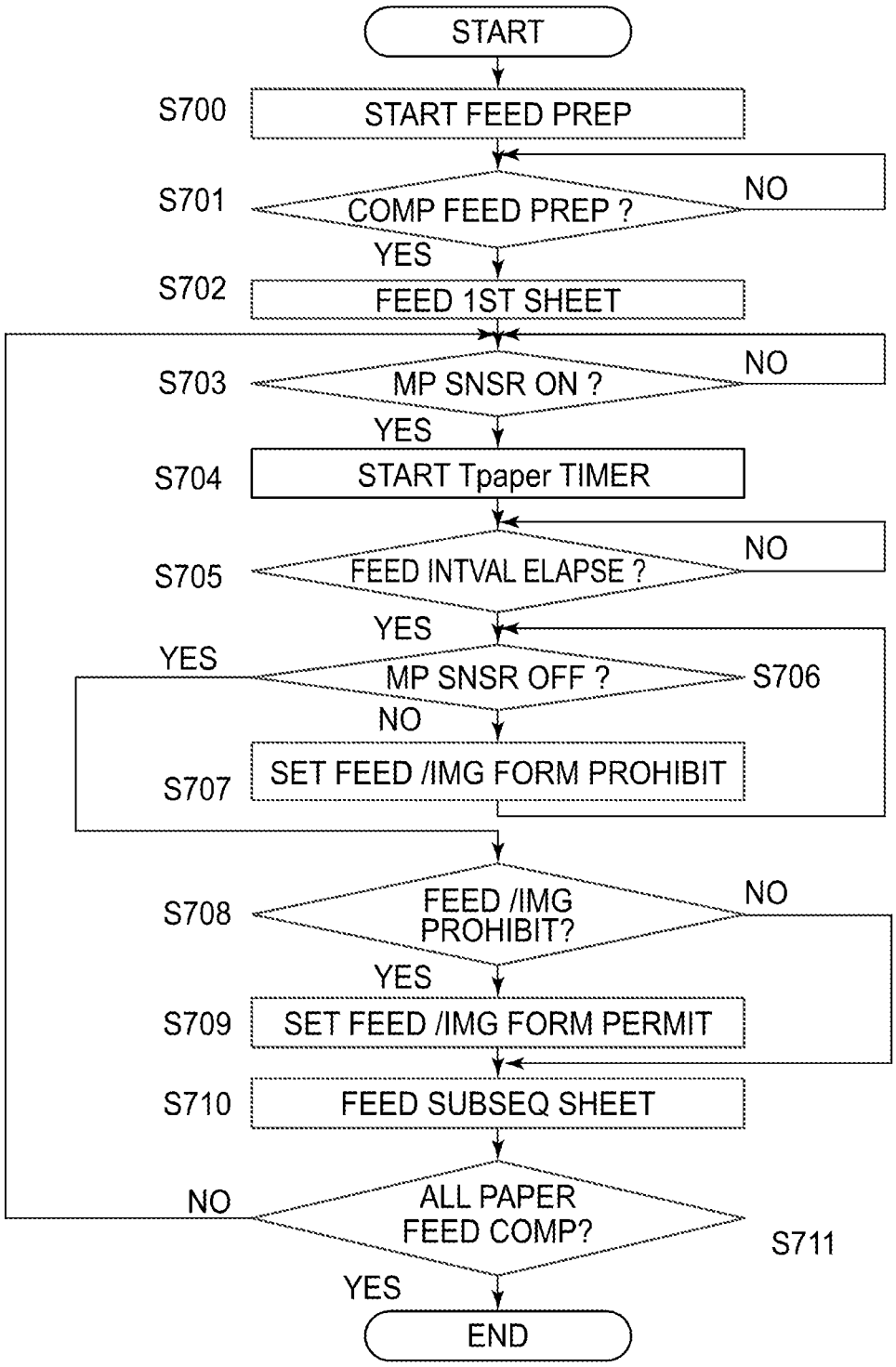
FIG. 7A and FIG. 7B are flowcharts showing a control sequence of image forming control and feeding control according to Embodiment 2.
Figure 7B:
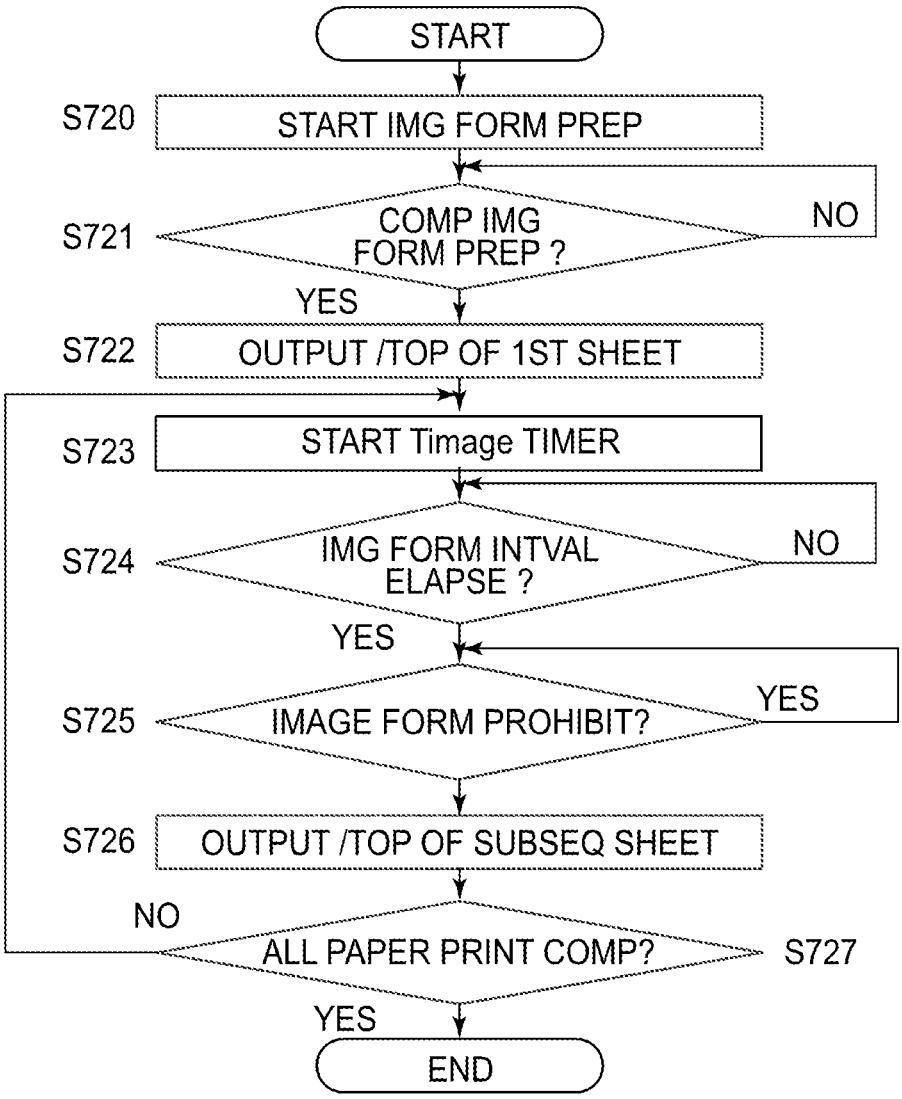

FIGS. 7A and 7B are flowcharts showing a control sequence of image forming control and feed control in the present embodiment. FIG. 7A is a flowchart showing a control sequence of a feed control of the paper stacked on the 50 MP tray, and FIG. 7B is a flowchart showing a control sequence of an image forming control, which performs image forming on the fed paper. The processes shown in FIGS. 7A and 7B are started when the engine portion 202 receives a print start command from the controller portion 201 and are executed by the engine portion 202. It is assumed that the engine portion 202 receives the image size information, paper size specification command and print reservation command from the controller portion 201 before receiving the print start command. When the processes shown in FIGS. 7A and 7B are started, it is assumed that permission is set for image formation and feeding of subsequent paper as described below.

(Control Sequence of Feed Control)

The control sequence for feed control of fed paper stacked in the MP tray 50 shown in FIG. 7A is explained below. The processes from S700 to S705 are similar to the processes from S500 to S505 shown in FIG. 5A of Embodiment 1, and are not explained here.

At S706, the engine portion 202 acquires the paper detection status of the MP feeding sensor 52 and concludes whether the trailing end of the feeding direction of the paper fed from the MP tray 50 has passed the MP feeding sensor 52 (MP feeding sensor off?). If the detection state of the acquired MP feeding sensor 52 is OFF, the engine portion 202 concludes that the trailing end of the fed paper has passed the MP feeding sensor 52, and proceeds to S708. On the other hand, if the detection state of the acquired MP feeding sensor 52 is not in the OFF state (it is in the ON state), the engine portion 202 concludes that the trailing end of the fed paper has not passed through the MP feeding sensor 52, and proceeds to S707. In S707, the engine portion 202 prohibits image formation and feeding of the subsequent paper from the MP tray 50, and returns the process to S706, so that the feeding operation of the subsequent paper from the MP tray 50 and the image forming operation do not start, because the trailing end of the preceding paper has not passed through the MP feeding sensor 52.

In S708, the engine portion 202 concludes whether or not the prohibition of image formation and feeding for the subsequent paper is set according to the process in S707 (feeding/image formation prohibition?). If the engine portion 202 concludes that the prohibition of image formation and feeding for the subsequent paper is set, the process proceeds to S709. On the other hand, if the engine portion 202 concludes that image forming and feeding for the subsequent paper is not prohibited (i.e., image forming and feeding for the subsequent paper is permitted), the process proceeds to S710. In S709, the engine portion 202 allows image forming and feeding for the subsequent paper. The processes in S710 and S711 are similar to the processes in S509 and S510 shown in FIG. 5A of Embodiment 1, and are not explained here.

(Control Sequence of Image Forming Control)

The control sequence of image forming control, which performs image forming on a fed paper, shown in FIG. 7B, is described below. The processes from S720 to S723 are similar to the processes from S520 to S523 shown in FIG. 5B of Embodiment 1, and are not explained here.

In S724, the engine portion 202 refers to the Timage timer and concludes whether the image forming interval has elapsed. If the engine portion 202 concludes that the image forming interval has passed based on the timer value of the Timage timer, it proceeds to S725, and if it concludes that the image forming interval has not passed, it returns the process to S724. In S725, the engine portion 202 concludes whether image formation for the subsequent paper is prohibited (image formation prohibited?) according to the process in S707 described above. If the engine portion 202 concludes that image formation for the subsequent paper is prohibited, it returns the process to S725. On the other hand, if the engine portion 202 concludes that image formation for the subsequent paper is not prohibited (i.e., image formation for the subsequent paper is permitted), the process proceeds to S726. The processes S726 and S727 are similar to the processes S525 and S526 shown in FIG. 5B of Embodiment 1, and are not explained here.

In the present embodiment, an example is described in which, if the trailing end of the preceding paper has not passed the MP feeding sensor 52 at the feed interval Tpaper according to the specified size of the paper, image formation and feeding of the subsequent paper are prohibited until the trailing end of the preceding paper has passed the MP feeding sensor 52. As described above, when continuously printing on paper stacked in an MP tray, even if inconsistencies in the timing of image forming and feeding operations occur due to paper size mismatches, the occurrence of jams and other feeding malfunctions can be suppressed by performing control according to the timing discrepancy.

As explained above, the present embodiment can suppress the occurrence of feeding malfunctions due to paper size mismatch.

Embodiment 3

In Embodiment 2, when the specified paper size (specified size) and the paper size stacked on the MP tray 50 (stacked size) are different, the start of feeding of the subsequent paper and the start of image formation are determined at the timing when the preceding paper passes through the MP feeding sensor. Embodiment 3 explains a control where it changes the start timing of image formation for the subsequent paper according to the amount of delay in timing of feeding when the specified paper size (specified size) and the paper size stacked on the MP tray 50 (stacked size) are different. The configuration of the image forming apparatus and system configuration of the present embodiment are the same as those of Embodiments 1 and 2, and the same symbols are used for the same devices and components to omit the explanation.

Overview of Printing Operation of the Present Embodiment

Figure 8:
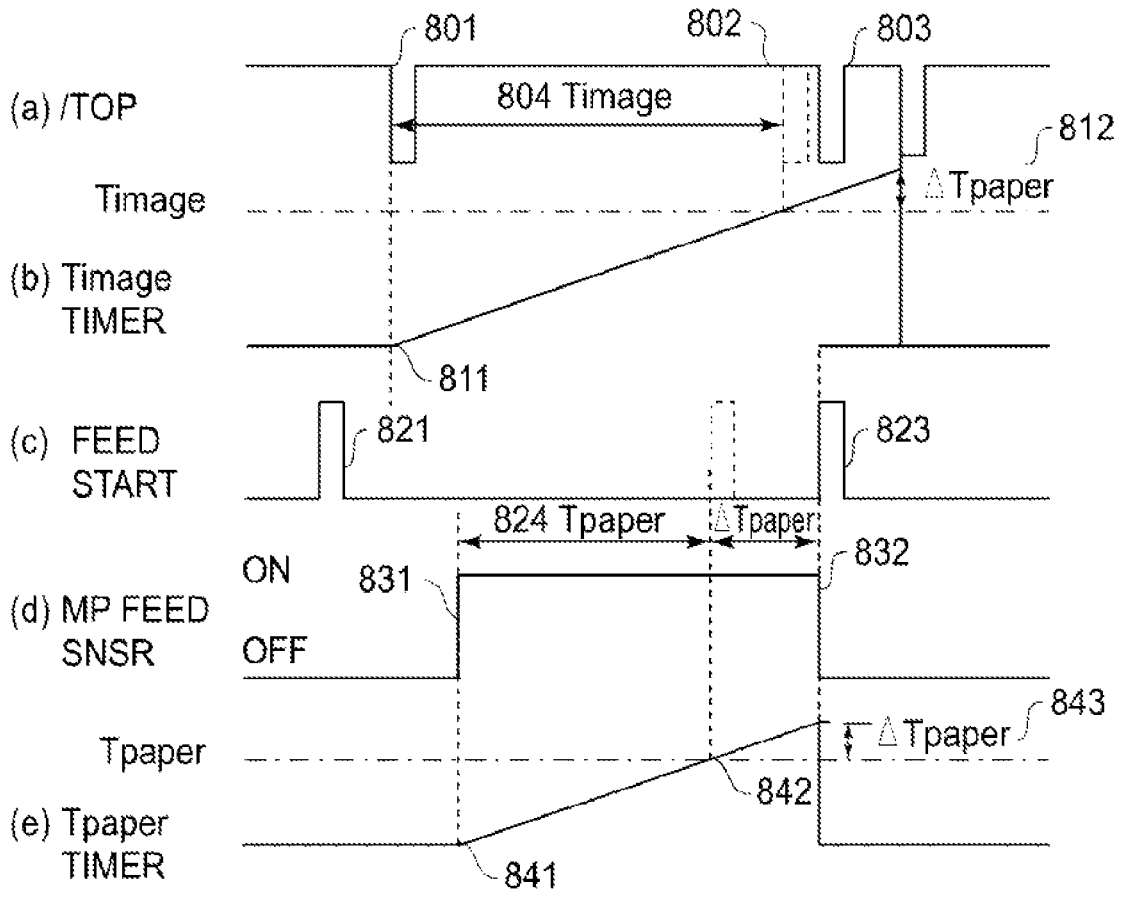
FIG. 8 is a timing chart showing image forming control and feeding control according to Embodiment 3.

FIG. 8 is a timing chart explaining image forming control and feed control in the present embodiment. In FIG. 8, the specified size of the paper is A5 size horizontal paper (210 mm wide×148 mm long in the feeding direction). On the other hand, the stacked size of the paper stacked on the MP tray 50 is LTR (letter) paper (paper width 215.9 mm×feeding direction length 279.4 mm), and the specified size and stacked size of the paper do not match, and the feeding direction length of the paper stacked on the MP tray 50 is longer. The parameters used in the image forming apparatus and printing control are the same as in Embodiment 1. The configuration of FIG. 8 is the same as that of FIG. 4 of Embodiment 1 and FIG. 6 of Embodiment 2 described above, and the explanation of how to view FIG. 8 is omitted.

When the engine portion 202 receives a print start command from the controller portion 201, it instructs the image control portion 206, paper feeding portion 208, etc. to start the print operation in order to perform image forming preparation operation for the print operation. Upon receiving notification from the image control portion 206 that image forming control is ready, the engine portion 202 outputs the /TOP signal (801) for the first sheet of paper to the controller portion 201 (part (a) of FIG. 8). The Timage timer starts at the timing (811) when the reference /TOP signal (801) is output (part (b) of FIG. 8). The engine portion 202 controls the image forming interval so that the image forming interval is the image forming interval Timage (804) according to the specified size of the paper. When the Timage timer value reaches Timage (804) (part (b) of FIG. 8), the engine portion 202 outputs the /TOP signal (802) for the second sheet of paper to the controller portion 201 if the stacked size of the paper is the same as the specified size (part (a) of FIG. 8). The image forming interval Timage in FIG. 8 can be calculated using (Formula 1) described in FIG. 3 of Embodiment 1.

Meanwhile, when the engine portion 202 completes the feeding preparation operation, it drives the MP tray pickup roller 51 to feed one sheet of paper from the MP tray 50 at the timing of the feeding start signal (821) (part (c) of FIG. 8). The engine portion 202 controls the feeding of the subsequent paper while ensuring that the desired feed interval is the feed interval Tpaper (824) corresponding to the same stacked size as the specified size of the paper. As in Embodiment 1 and 2, the feed interval Tpaper is controlled based on the timing when the MP feeding sensor 52 detects the leading end of the feeding direction of the preceding paper. When the MP feeding sensor 52 detects the leading end of the feeding direction of the paper fed from the MP tray 50 at timing (831) (part (d) of FIG. 8), the engine portion 202 starts the Tpaper timer at timing (841) (part (e) of FIG. 8). The feed interval Tpaper (824) in FIG. 4 is the feed interval when A5 size horizontal paper similar to the specified size is fed from the MP tray 50. It can be calculated using the (Formula 2) described in FIGS. 3A and 3B of Embodiment 1.

The engine portion 202 checks the status of the MP feeding sensor 52 when the timer value of the Tpaper timer reaches the feed interval Tpaper (824) (part (e) of FIG. 6). In the present embodiment, feed control (setting of feed interval Tpaper (824)) is performed assuming that A5 size paper is stacked MP tray 50 in a horizontal position. However, the paper actually stacked in the MP tray 50 is LTR (letter) paper (paper width 215.9 mm×feeding direction length 279.4 mm), which is longer than the feeding direction length of 148 mm for A5 size horizontal paper. Therefore, at the timing (842) when the timer value of the Tpaper timer reaches the feed interval Tpaper (824), the trailing end of the feeding direction of the preceding paper has not yet passed the MP feeding sensor 52.

Therefore, if the engine portion 202 concludes that the trailing end of the feeding direction of the preceding paper has not passed the MP feeding sensor 52 at timing (842), it prohibits image formation and feeding of the subsequent paper. Since the engine portion 202 prohibits image formation on the subsequent paper, it does not output the /TOP signal (802) and does not start image formation on the subsequent paper even when the Timage timer reaches the image forming interval Timage (804). The time measurement by the Tpaper timer continues as is.

Then, when the MP feeding sensor 52 detects the passage of the trailing end of the feeding direction of the fed paper (preceding paper) from the MP tray 50 at timing (832) (part (d) of FIG. 8), the engine portion 202 performs the following process. That is, the engine portion 202 calculates the difference ΔTpaper (843) from the current Tpaper timer value and the feed interval Tpaper. The engine portion 202 then switches the image forming interval of the Timage timer from Timage to (Timage+ΔTpaper (812)) using the calculated difference ΔTpaper (843). In addition, the engine portion 202 changes the prohibition setting for image formation and feeding of the subsequent paper to a permitted setting.

In accordance with the permission setting for feeding of the subsequent paper, the engine portion 202 drives the MP tray pickup roller 51 and feeds one sheet of the subsequent paper from the MP tray 50 at the timing of the feeding start signal (823). When the engine portion 202 is allowed to form images on the subsequent paper and the Timage timer reaches the image forming interval (Timage+ΔTpaper), it outputs the /TOP signal (803) for the second sheet (subsequent paper) to the controller portion 201 (part (a) of FIG. 8).

[Control Sequence for Image Forming Control and Feed Control]

Figure 9A:
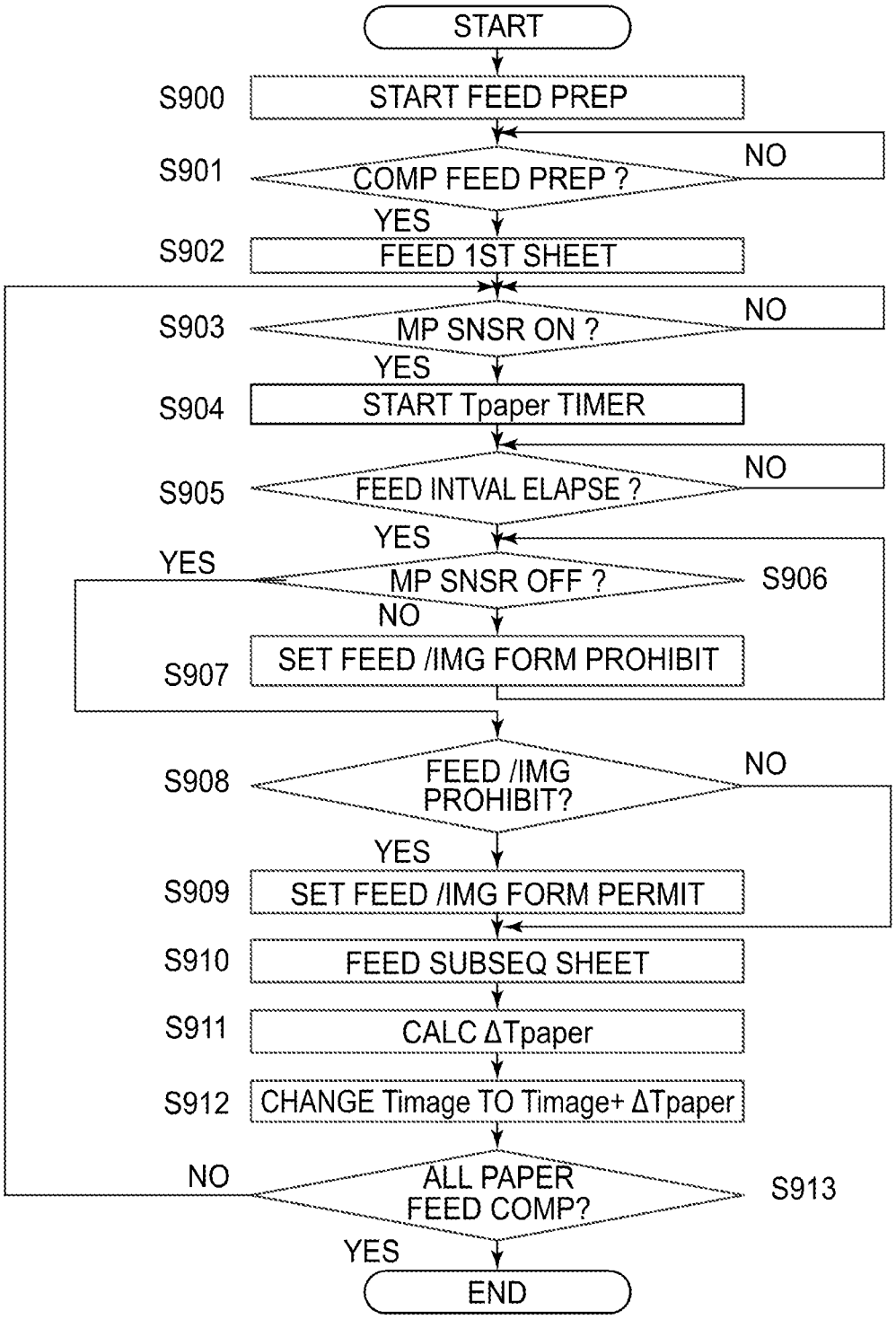
FIG. 9A and FIG. 9B are flowcharts showing a control sequence of image forming control and feeding control according to Embodiment 3.
Figure 9B:
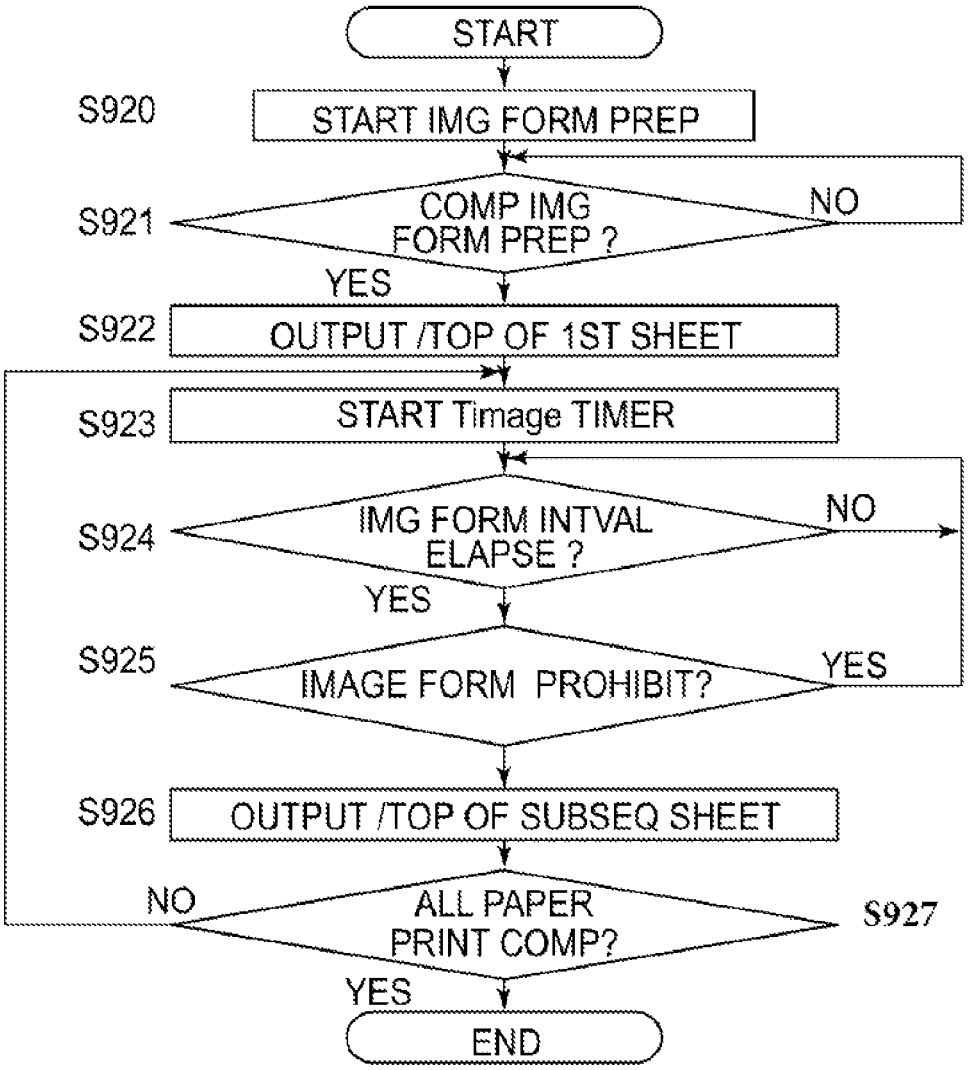

FIGS. 9A and 9B are flowcharts showing a control sequence for image forming control and feed control in the present embodiment. FIG. 9A is a flowchart showing a control sequence for feeding control of paper stacked in the 50 MP tray, and FIG. 9B is a flowchart showing a control sequence for image forming control, in which an image is formed on a fed paper. The processes shown in FIGS. 9A and 9B are started when the engine portion 202 receives a print start command from the controller portion 201 and are executed by the engine portion 202. It is assumed that the engine portion 202 receives the image size information, paper size specification command and print reservation command from the controller portion 201 before receiving the print start command. When the processes shown in FIGS. 9A and 9B are activated, it is assumed that image formation and feeding for the subsequent paper, as described below, are permitted.

(Control Sequence of Feed Control)

The control sequence for feed control of fed paper stacked in the MP tray 50 shown in FIG. 9A is explained below. The processes from S900 to S910 are similar to the processes from S500 to S510 shown in FIG. 7A of Embodiment 2, and are not explained here.

In S911, the engine portion 202 obtains the time of the Tpaper timer at the timing when the trailing end of the feeding direction of the preceding paper passes the MP feeding sensor 52, and calculates the difference ΔTpaper from the feed interval Tpaper. The difference ΔTpaper indicates how much the timing for feeding of the subsequent paper is delayed from the timing when the preceding paper is a specified size paper.

The difference ΔTpaper can also be calculated using the following (Formula 7).

$$\text{Difference } \Delta T\text{paper}=((\text{stacked size}+\text{paper interval})-(\text{specified size}+\text{paper interval}))/\text{feeding speed} \quad \text{(Formula 7)}$$

In the present embodiment, the stacked size (length of the LTR paper feeding direction) is 279.4 mm and the paper interval is 140 mm. The specified size (length of the feeding direction of A5 size horizontal paper) is 148 mm. Therefore, based on (Formula 7), the difference ΔTpaper is ((279.4 mm+140 mm)−(148 mm+140 m))/150 mm/s=131.4 mm/150 mm/s≈0.876 s (seconds).

In S912, the engine portion 202 switches the image forming interval of the Timage timer from the image forming interval Timage when the paper is a specified size to the image forming interval (Timage+ΔTpaper) to which the difference ΔTpaper is added. The process of S913 is similar to the process of S711 shown in FIG. 7A of Embodiment 2, and is not explained here.

(Control Sequence of Image Forming Control)

The control sequence of image forming control, which performs image forming on a fed paper, shown in FIG. 9B, is described below. The processes from S920 to S923 are similar to the processes from S720 to S723 shown in FIG. 7B of Embodiment 2, and are not explained here.

In S924, the engine portion 202 refers to the Timage timer and concludes whether the image forming interval has elapsed. If the engine portion 202 concludes that the image forming interval has elapsed based on the Timage timer value, it proceeds to S925, and if it concludes that the image forming interval has not elapsed, it returns the process to S924. In S925, the engine portion 202 determines whether or not image formation on the subsequent paper is prohibited by the process in S907 of FIG. 9A above (image formation prohibited). If the engine portion 202 concludes that image formation on the following paper is prohibited, the engine portion 202 returns the process to S924. On the other hand, if the engine portion 202 concludes that image formation on the subsequent paper is not prohibited (i.e., image formation on the subsequent paper is permitted), the process proceeds to S926. The processes of S926 and 5927 are similar to the processes of S726 and S727 shown in FIG. 7B of Embodiment 2, and are not explained here.

As described above, even if inconsistencies in the timing of image forming control and feed control occur due to control delays caused by paper size mismatches, etc., control can be adjusted to match the timing discrepancies, thereby preventing jams and other feeding malfunctions.

As explained above, the present embodiment can suppress the occurrence of feeding malfunctions of paper due to paper size mismatch.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-144068 filed on Sep. 3, 2021, which is hereby incorporated by reference herein in its entirety.

What is claimed is:

1. An image forming apparatus comprising:

a stacking unit on which a plurality of recording materials are stackable;

a feeding roller configured to feed the recording material stacked on the stacking unit;

an image forming unit configured to form an image on the recording material fed by the feeding roller;

a detecting unit configured to detect the recording material fed by the feeding roller toward the image forming unit; and a controlling unit configured to control the image forming unit and the feeding roller, the controlling unit controlling a feed interval between the recording materials continuously fed by the feeding roller, wherein the controlling unit sets the feed interval between a first recording material precedently fed and a second recording material subsequent to the first recording material to a first feed interval based on an image signal which is received, and wherein, in a case that the detecting unit does not detect a trailing end of the first recording material with respect to a feeding direction after detecting the first recording material until a predetermined time elapses, the controlling unit sets the feed interval to a second feed interval longer than the first interval and determines a timing of image forming on the second recording material by the image forming unit based on the second feed interval.

2. An image forming apparatus according to claim 1, wherein the controlling unit determines the second feed interval based on a maximum size of the recording material stackable on the stacking unit with respect to the feeding direction.

3. An image forming apparatus according to claim 2, wherein the controlling unit causes the feeding unit to feed the second material at a timing when the detecting unit detects that the trailing end of the first recording material passes through.

4. An image forming apparatus according to claim 1, wherein, in a case that the detecting unit detects that the trailing end of the first recording material passes through at a timing delayed for a delayed time from the predetermined time, the controlling unit shifts a timing when the second recording material is to be fed by the feeding unit by the delayed time.

5. An image forming apparatus according to claim 1, wherein an image forming interval between the first recording material and the second recording material is determined based on a length of the image signal corresponding to the first recording material and a length of a period when an image signal is not output between the image signal corresponding to the first signal and the image signal corresponding to the second recording material.

6. An image forming apparatus according to claim 1, wherein the image forming unit includes an image bearing member and a transfer member configured to transfer an image formed on the image bearing member to the recording material fed by the feeding roller, and wherein a distance between the transfer member and the detecting unit is not more than a distance where the image is moved from a position where the image is formed on the image bearing member to the transfer member.

* * * * *